US008596841B2

(12) United States Patent
Yagi et al.

(10) Patent No.: US 8,596,841 B2
(45) Date of Patent: Dec. 3, 2013

(54) VEHICLE LAMP

(75) Inventors: Takayuki Yagi, Shizuoka (JP); Motohiro Komatsu, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 258 days.

(21) Appl. No.: 11/959,504

(22) Filed: Dec. 19, 2007

(65) Prior Publication Data

US 2008/0144328 A1 Jun. 19, 2008

(30) Foreign Application Priority Data

Dec. 19, 2006 (JP) ..... 2006-341532
Dec. 19, 2006 (JP) ..... 2006-341533

(51) Int. Cl.
*F21V 1/00* (2006.01)

(52) U.S. Cl.
USPC ..... 362/509; 362/516; 362/517; 362/518; 362/519; 362/520; 362/521; 362/522; 362/543; 362/544; 362/545

(58) Field of Classification Search
USPC ..... 362/459–549
See application file for complete search history.

(56) References Cited

U.S. PATENT DOCUMENTS 5,749,642 A * 5/1998 Kimura et al. ..... 362/296.06
6,811,289 B2 * 11/2004 Nakata ..... 362/516
7,118,260 B2 * 10/2006 Tsukamoto et al. ..... 362/544
7,178,960 B2 * 2/2007 Ishida ..... 362/545
7,281,833 B2 * 10/2007 Akiyama ..... 362/545
2002/0034081 A1 3/2002 Serizawa
2006/0285347 A1 12/2006 Okada

FOREIGN PATENT DOCUMENTS

DE 10145963 A1 4/2002
DE 102006023163 A1 11/2006
JP 2005-44683 A 2/2005

OTHER PUBLICATIONS

German Office Action dated Jun. 18, 2009.

* cited by examiner

*Primary Examiner* — William Carter
(74) *Attorney, Agent, or Firm* — Sughrue Mion, PLLC

(57) ABSTRACT

A vehicle lamp is provided. The vehicle lamp includes a lens disposed on an optical axis of the vehicle lamp, the optical axis extending in a front-and-rear direction of the vehicle lamp, the lens comprising a first concave lens portion; a plurality of light emitting elements disposed to a rear side of the lens and around the optical axis at regular intervals in a circumferential direction, the plurality of light emitting elements comprising at least one first light emitting element disposed to a rear side of the first concave lens portion; at least one first reflector corresponding to the at least one first light emitting element and disposed between the corresponding first light emitting element and the optical axis, wherein the first reflector comprises a first reflecting surface which reflects light from the corresponding first light emitting element toward the first concave lens portion.

19 Claims, 17 Drawing Sheets

VEHICLE LAMP

FIELD OF THE PRESENT INVENTION

Apparatuses consistent with the present invention relate to vehicle lamps, and more particularly, to vehicle lamps which use a light emitting element as a light source.

DESCRIPTION OF THE RELATED ART

In recent years, a light emitting element such as a light emitting diode has been developed as a light source of a vehicle lamp.

For example, there is a vehicle lamp having a convex lens disposed on an optical axis extending in a front-and-rear direction of the lamp and a light emitting element disposed in the vicinity of a rear focal point of the convex lens (see, e.g., JP 2005-044683 A). The convex lens deflects a direct light emitted from the light emitting element and irradiates the light in a forward direction of the lamp.

This arrangement allows precise control of the direct light from the light emitting element.

However, because the light emitting element is positioned in the vicinity of the rear focal point of the convex lens, the lamp cannot be configured to have a shorter length in the front-and-rear direction. Thus, it is difficult to configure the lamp to be sufficiently slim. In addition, only a single light emitting element can be disposed in the vicinity of the rear focal point of the convex lens. Therefore, a sufficient amount of light irradiation cannot be ensured.

BRIEF SUMMARY OF THE PRESENT INVENTION

It is an object of the present invention to attain a vehicle lamp having a slim profile and to ensure a sufficient amount of light irradiation in a vehicle lamp having a light emitting element as a light source while maintaining precise control of a light distribution.

According to an aspect of the invention, a vehicle lamp includes a lens disposed on an optical axis extending in a front-and-rear direction of the vehicle lamp. The lens includes a concave lens portion. The vehicle lamp further includes a plurality of light emitting elements disposed on a rear side of the lens and around the optical axis at regular intervals in a circumferential direction. The plurality of light emitting elements includes a first light emitting element disposed on a rear side of the concave lens portion. The vehicle further includes a first reflector disposed between the first light emitting element and the optical axis. A first reflecting surface of the first reflector reflects light from the first light emitting element toward the concave lens portion. A sectional shape of the first reflecting surface, taken along a plane including a light emitting center of the first light emitting element and the optical axis, is an elliptical shape.

According to another aspect of the invention, the vehicle lamp may further include a second reflector, the lens may further include a convex lens portion, and the plurality of light emitting elements may further include a second light emitting element disposed on a rear side of the convex lens portion. The second reflector is disposed between the second light emitting element and the optical axis. A second reflecting surface of the second reflector reflects light from the second light emitting element toward the convex lens portion. A sectional shape of the second reflecting surface, taken along a plane including a light emitting center of the second light emitting element and the optical axis, is a shape of one branch of a hyperbola on a side of the second light emitting element, the hyperbola having a first focal point in the vicinity of a rear focal point of the convex lens portion and a second focal point in the vicinity of the light emitting center of the second light emitting element.

A type of "vehicle lamp" is not particularly restricted. For example, the vehicle lamp may be a headlamp, a fog lamp, a cornering lamp, a daytime running lamp, or any other lamp which may be implemented with a light emitting diode, or a lamp unit installed as one of the components of any of these lamps.

The "optical axis" denotes an axis extending in the front-and-rear direction of the lamp, and the "optical axis" may be, but is not necessarily, coincident with an axis extending in a front-and-rear direction of the vehicle.

The "concave lens portion" denotes a lens portion having a negative refracting power, and is not restricted to a specific shape. For example, the concave lens portion may have a shape of a planoconcave lens, a double-concave lens or a concave meniscus lens. Moreover, the optical axis of the "concave lens portion" may be, but is not necessarily, parallel to the optical axis.

In the specification, for convenience of explanation, the "front focal point of the concave lens portion" denotes a focal point on the front side of the lamp of a pair of front and rear focal points of the concave lens portion (i.e., a point to be a "rear focal point" of a concave lens in an image forming optical system), and the "rear focal point of the concave lens portion" denotes a focal point positioned on the rear side of the lamp of the pair of front and rear focal points of the concave lens (i.e., a point to be a "front focal point" of the concave lens in the image forming optical system).

The "convex lens portion" denotes a lens portion having a positive refracting power, and is not restricted to a specific shape. For example, the convex lens portion may have a shape of a planoconvex lens, a double-convex lens or a convex meniscus lens.

The "light emitting element" denotes a light source device having a surface emitting chip which emits light substantially from a point. The light emitting element may include, e.g., a light emitting diode or a laser diode.

The specific values, for example, the number of the "light emitting elements" and the interval in the circumferential direction are not particularly restricted. The light emitting elements do not need to have such a configuration that all of them are always turned ON at the same time. All of the light emitting elements or some of them may be turned ON according to an adequate timing.

Although the "reflecting surface" of the first reflector is formed to take the elliptical sectional shape taken along the plane including the light emitting center of the light emitting element and the optical axis, a sectional shape taken along a plane other than the plane including the light emitting center of the light emitting element and the optical axis is not particularly restricted.

Although the "reflecting surface" of the second reflector is formed in the hyperbolic sectional shape taken along the plane including the light emitting center of the light emitting element and the optical axis, a sectional shape taken along a plane other than the plane including the light emitting center of the light emitting element and the optical axis is not particularly restricted.

Other objects and aspects of the present invention will be apparent from the following description, the drawings and the claims.

DETAILED DESCRIPTION OF EXEMPLARY EMBODIMENTS OF THE PRESENT INVENTION

Hereinafter, exemplary embodiments of the invention will be explained with reference to the drawings. The following exemplary embodiments do not limit the scope of the invention.

First Exemplary Embodiment

Figure 1:
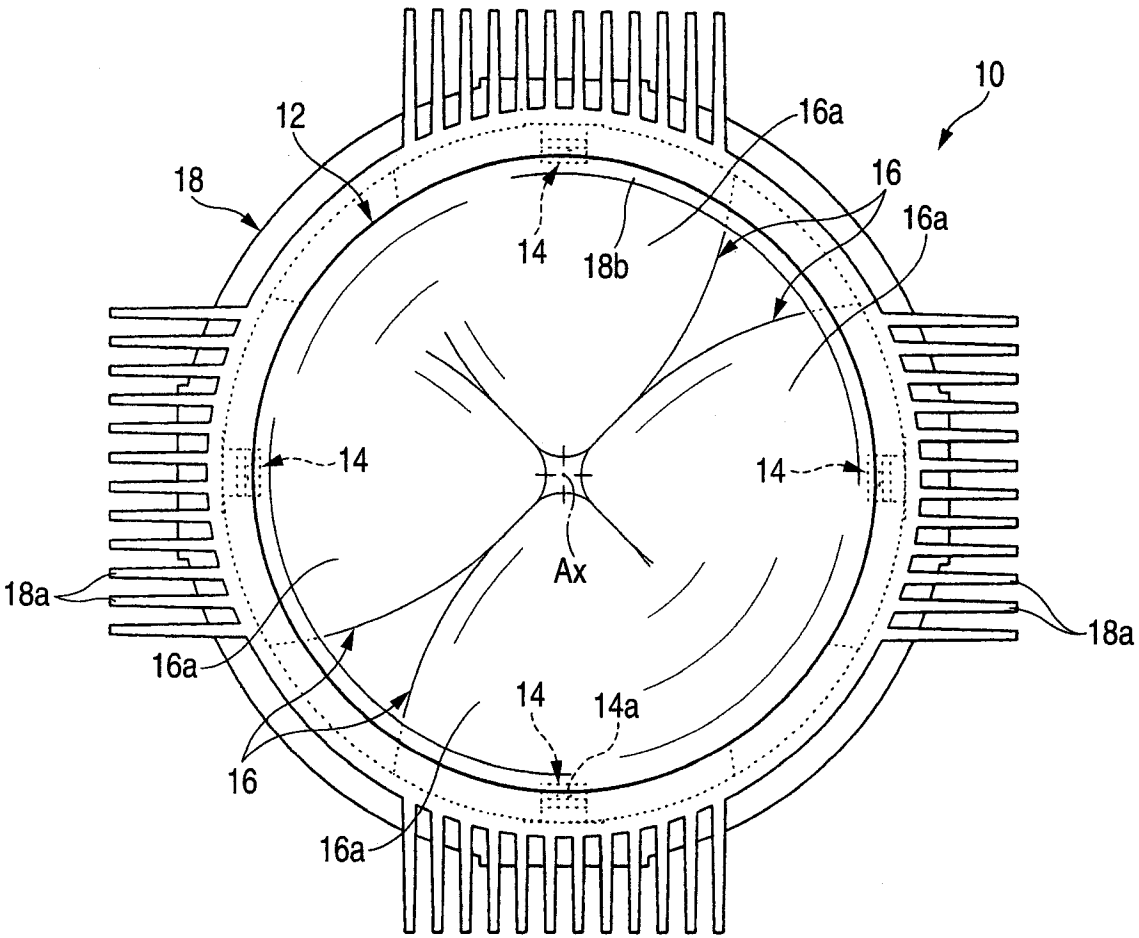
FIG. 1 is a front view showing a vehicle lamp according to a first exemplary embodiment of the present invention.
Figure 2:
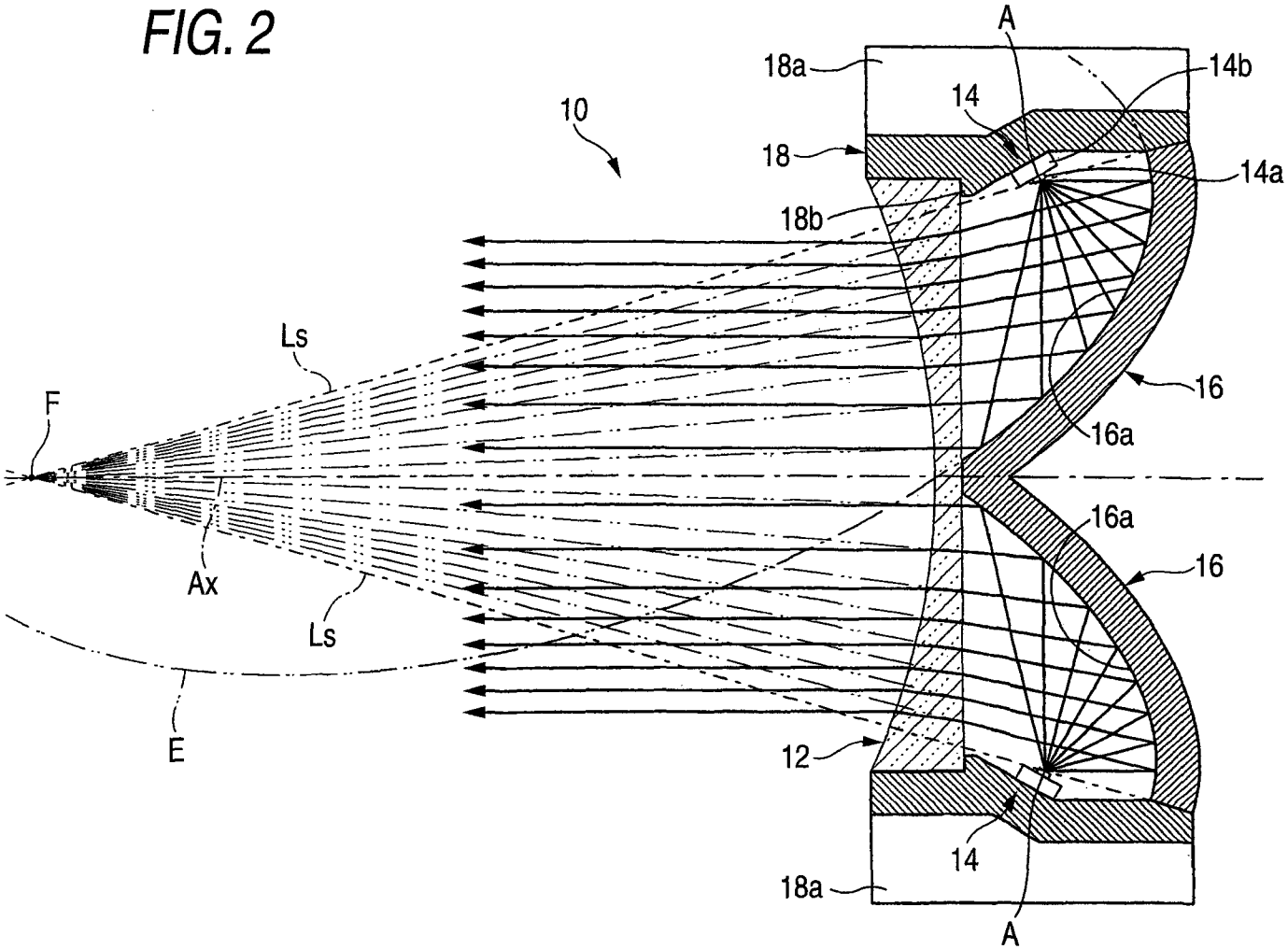
FIG. 2 is a side sectional view of the vehicle lamp of FIG. 1.

As shown in the FIGS. 1 and 2, a vehicle lamp 10 according to a first exemplary embodiment of the present invention includes a concave lens 12 disposed on an optical axis Ax extending in a front-and-rear direction of the lamp 10 (i.e., in a direction behind and in front of the page), four light emitting elements 14 disposed behind the concave lens 12, fourth reflectors 16, and a lens holder 18. The vehicle lamp 10 is used as a lamp unit of a vehicle headlamp in a state in which it is incorporated to enable a regulation of the optical axis for a lamp body (not shown). In that case, the vehicle lamp 10 serves to irradiate a light for forming a part of a high beam light distribution pattern in a state in which the optical axis Ax is disposed to be extended in a front-and-rear direction of the vehicle.

The concave lens 12 in this exemplary embodiment is a planoconvex aspherical lens in which a front side surface is a concave surface and a rear side surface is a plane, and is fixed and supported onto the lens holder 18 at a peripheral edge portion thereof. The lens holder 18 is a metallic member formed annularly, and a lens support portion 18*b* for fixing and supporting the concave lens 12 is formed on an inner peripheral surface of a front end thereof. An effective diameter of the concave lens 12 is defined by an inside diameter of the lens support portion 18*b*. The concave lens 12 has a relative aperture (i.e., a focal ratio, a ratio of the effective diameter of the concave lens 12 to a focal length thereof) set to be a value which is equal to or smaller than one (more specifically, a value of approximately 0.6).

The four light emitting elements 14 are disposed at a regular interval on the same circumference around the optical axis Ax between the concave lens 12 and a rear focal point of the concave lens 12. More specifically, each of the light emitting elements 14 is disposed in a position placed almost just behind an outer peripheral edge of the concave lens 12 in the vicinity of a rear part of the concave lens 12.

Each of the light emitting elements 14 is a white light emitting diode, and includes a light emitting chip 14*a* having a square light emitting surface in a size of approximately 1 mm square and a substrate 14*b* for supporting the light emitting chip 14*a*. However, other light emitting chip geometries may also be used. The light emitting chip 14*a* is sealed with a thin film formed to cover a light emitting surface thereof. The light emitting element 14 is fixed and supported onto an inner peripheral surface of the lens holder 18 in a state in which the light emitting chip 14*a* is tilted slightly rearward toward the optical axis Ax (more specifically, a state in which the light emitting chip 14*a* is tilted by approximately 30 degrees rearward with respect to an orthogonal direction to the optical axis Ax).

A plurality of radiation fins 18*a* are formed on a portion of the lens holder 18 positioned on the outer peripheral side from each light emitting element 14 with respect to the optical axis Ax in the lens holder 18, and the plurality of radiation fins 18*a* protrude outward from the lens holder 18.

The four reflectors 16 are disposed to cover the four light emitting elements 14 like a semidome between each of the light emitting elements 14 and the optical axis Ax respectively, and serve to forward reflect light emitted from the light emitting element 14. The four reflectors 16 are formed integrally with each other and are fixed and supported onto a rear end of the lens holder 18. In that case, each of the reflectors 16 is formed in such a manner that a front edge thereof extends to a surface at a rear side of the concave lens 12.

A reflecting surface 16*a* of the reflector 16 takes a sectional shape, along a plane including a light emitting center A of the light emitting element 14 and the optical axis Ax, that is formed by an ellipse E in which the light emitting center A of the light emitting element 14 is set to be a first focal point and a front focal point F of the concave lens 12 is set to be a second focal point (that is, a segment Ls is set to be a major axis of the ellipse E). In this first exemplary embodiment, the reflecting surface 16*a* of the reflector 16 is a spheroid surface formed by rotating the ellipse E around the major axis.

Most of the light emitted from the light emitting element 14 is incident on the reflecting surface 16*a* of the reflector 16, and is reflected forward by the reflecting surface 16*a* and is incident on the concave lens 12. In that case, the reflecting surface 16*a* of the reflector 16 is the spheroid surface. Therefore, all of the light emitted from the light emitting elements 14 and reflected by the reflecting surfaces 16*a* is incident, on the concave lens 12, as convergent light which is transmitted toward the front focal point F of the concave lens 12. Thus, all of the light emitted from the light emitting elements 14 and transmitted forward from the concave lens 12 is parallel with the optical axis Ax.

Figure 3:
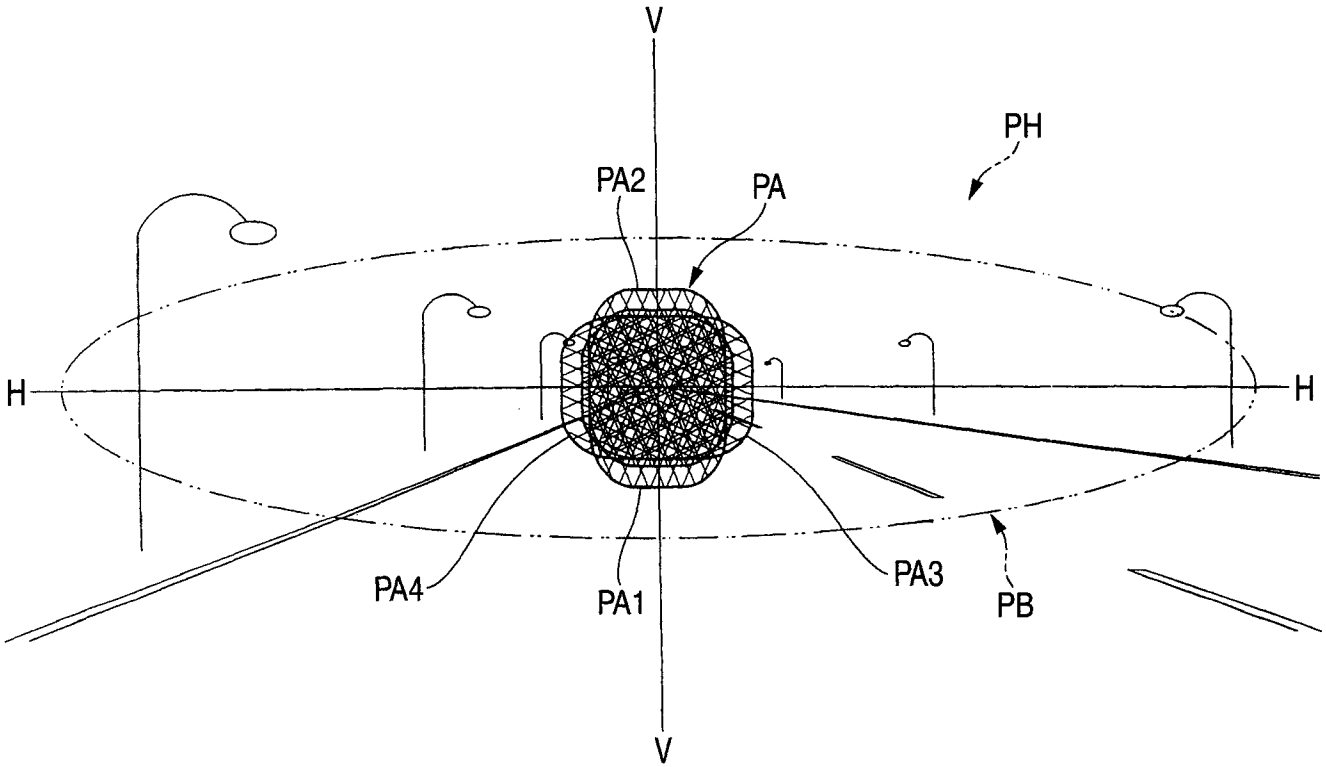
FIG. 3 is a perspective view showing a light distribution pattern of the vehicle lamp of FIG. 1 formed on a virtual vertical screen disposed at a position of 25 m in front of the vehicle lamp by a light irradiated forward from the lamp.

FIG. 3 is a perspective view showing a light distribution pattern PA of light irradiated forward from the vehicle lamp 10 according to the first exemplary embodiment of the present invention. The light distribution pattern PA is formed on a virtual vertical screen disposed in a forward position of 25 m from the vehicle lamp 10.

As shown in FIG. 3, the light distribution pattern PA takes a shape of a spot which is formed around axis H-V to be a vanishing point in a front direction of the lamp and is formed as a part of a light distribution pattern PH for a high beam. More specifically, the light distribution pattern PH for a high beam is formed as a synthetic light distribution pattern of the light distribution pattern PA and a diffused light distribution pattern PB formed by a light irradiated forward from another lamp unit which is not shown, and a hot zone to be a high luminous intensity region is formed by the light distribution pattern PA.

The light distribution pattern PA is formed as a synthetic light distribution pattern of fourth light distribution patterns PA1, PA2, PA3 and PA4. The light distribution patterns PA1, PA2, PA3 and PA4 are formed by turning ON each of the light emitting elements 14 disposed in upper, lower, left and right positions of the optical axis Ax, and all of the light distribution patterns PA1, PA2, PA3, and PA4 have spot-like light distribution patterns. This is based on the fact that all of the light emitted from the respective light emitting elements 14 and transmitted forward from the concave lens 12 is parallel with the optical axis Ax.

As described above in detail, the vehicle lamp 10 according to the first exemplary embodiment includes the concave lens 12 disposed on the optical axis Ax extending in the front-and-rear direction of the lamp 10, and the light emitting elements 14 are disposed behind the concave lens 12. However, the four light emitting elements 14 are disposed at a regular interval on the same circumference around the optical axis Ax in the vicinity of the rear part of the concave lens 12, and the reflectors 16 for forward reflecting the lights emitted from the light emitting elements 14 are disposed between the light emitting elements 14 and the optical axis Ax, respectively. Therefore, the light emitted from the light emitting elements 14 is incident on the reflectors 16, and is then reflected by the reflectors 16 such that the reflected light is incident on the concave lens 12, and is deflected and controlled by the concave lens 12 and is thus emitted forward.

The sectional shape of the reflecting surface 16*a* of one of the reflectors 16 which is taken along the plane including the light emitting center A of the corresponding light emitting element 14 and the optical axis Ax is formed by the ellipse E in which the light emitting center A of the light emitting element 14 is set to be the first focal point and the front focal point F of the concave lens 12 is set to be the second focal point. Therefore, the light reflected by the reflectors 16 is incident, on the concave lens 12, as convergent light transmitted toward the front focal point F of the concave lens 12 to be the second focal point of the ellipse E in the plane. Therefore, the light emitted from the concave lens 12 is changed into light which is parallel with the optical axis Ax in at least the plane. Consequently, it is possible to carry out a light distribution control with high precision.

Moreover, the light emitting elements 14 and their corresponding reflectors 16 are disposed in the vicinity of the rear part of the concave lens 12. Therefore, it is possible to reduce a length of the vehicle lamp. By turning ON the four light emitting elements 14, it is possible to ensure a sufficient amount of an irradiated light.

According to the first exemplary embodiment, in the vehicle lamp 10 using the light emitting elements 14 as a light source, it is thus possible to carry out a light distribution control with high precision, thereby reducing a thickness of the lamp and ensuring a sufficient amount of an irradiated light.

In the first exemplary embodiment, particularly, the light emitting elements 14 and their corresponding reflectors 16 are disposed in the vicinity of the rear part of the concave lens 12. Therefore, it is possible to sufficiently reduce the length of the vehicle lamp. By reducing the thickness of the lamp, thus, it is possible to increase a degree of freedom of a layout in the lamp.

In addition, in the vehicle lamp 10 according to the first exemplary embodiment, the reflecting surfaces 16*a* of the reflectors 16 are spheroid surfaces. Therefore, all of the light emitted from the light emitting elements 14 and transmitted forward from the concave lens 12 are changed into light which is parallel with the optical axis Ax. By turning ON the light emitting elements 14, consequently, it is possible to form the spot-like light distribution patterns PA1, PA2, PA3 and PA4 in the direction of the front face of the lamp. If the four light emitting elements 14 are turned ON at the same time, the light distribution pattern PA is formed as the synthetic light distribution pattern of the four light distribution patterns PA1, PA2, PA3 and PA4.

In the vehicle lamp 10 according to the first exemplary embodiment, moreover, the relative aperture of the concave lens 12 is set to have a value of approximately 0.6. Therefore, it is possible to form the concave lens 12 to be comparatively thin. Moreover, an angle formed by the direction of the light reflected by the reflectors 16 with the optical axis Ax can be reduced to have a comparatively small value. Therefore, the deflecting control for the light reflected from the reflector 16 can be carried out with high precision.

In the vehicle lamp 10 according to the first exemplary embodiment, furthermore, each of the light emitting elements 14 is supported on the metallic lens holder 18 and the radiation fins 18*a* are formed in the portion of the lens holder 18 which is placed on the outer peripheral side of the light emitting element 14 with respect to the optical axis Ax. Therefore, it is possible to move a heat generated with the ON operation of the light emitting elements 14 by a heat conducting function to the lens holder 18 which has a large heat capacity so as to efficiently dissipate the heat from the lens holder 18 using the radiation fins 18*a*. In that case, the radiation fins 18*a* are positioned on the outer peripheral side of the respective light emitting elements 14. Therefore, it is possible to maintain the lamp to be thin. The lens holder 18 may be assembled from separate holders that are provided for each of the light emitting elements 14. However, in the first embodiment, the lens holder 18 is formed in a one-piece structure, and the four light emitting elements 14 are supported on the common lens holder 18. Therefore, it is possible to increase a radiating efficiency and to enhance positioning precision of each of the light emitting elements 14.

Although the above description has been given on the assumption that the light emitting elements 14 are disposed in a tilting direction of approximately 30 degrees toward the rear side with respect to the orthogonal direction to the optical axis Ax in the first exemplary embodiment, it is also possible to employ a structure in which other inclination angles are set, or a structure in which the light emitting element 14 is disposed in an orthogonal direction to the optical axis Ax.

While the description has been given on the assumption that the four light emitting elements 14 are disposed at the regular interval on the same circumference around the optical axis Ax in the first exemplary embodiment, it is also possible to employ a structure in which the four light emitting elements 14 are disposed in positions shifted from the same circumference or a structure in which they are disposed at an irregular interval in a circumferential direction.

While there has been employed the structure in which the four light emitting elements 14 are disposed around the optical axis Ax in the first exemplary embodiment, it is also possible to employ a structure in which three light emitting elements 14 or less, or five light emitting elements 14 or more are disposed.

Although the description has been given on the assumption that the relative aperture of the concave lens 12 is set to have the value of approximately 0.6 in the first exemplary embodiment, it is possible to obtain almost the same functions and advantages as those in the first exemplary embodiment if the relative aperture is set to have a value which is equal to or smaller than one.

While the description has been given on the assumption that the ellipse E, forming the sectional shape of the reflecting surface 16*a* of one of the reflectors 16 which is taken along the plane including the optical axis Ax, sets the light emitting center A of the corresponding light emitting element 14 to be the first focal point and the front focal point F of the concave lens 12 to be the second focal point in the first exemplary embodiment, the light emitted from the light emitting element 14 and transmitted forward from the concave lens 12 is changed into a light which is almost parallel with the optical axis Ax if the first and second focal points are positioned in the vicinity of the light emitting center A and the front focal point F respectively. Therefore, it is possible to obtain almost the same functions and advantages as those in the first exemplary embodiment.

Second Exemplary Embodiment

Figure 4:
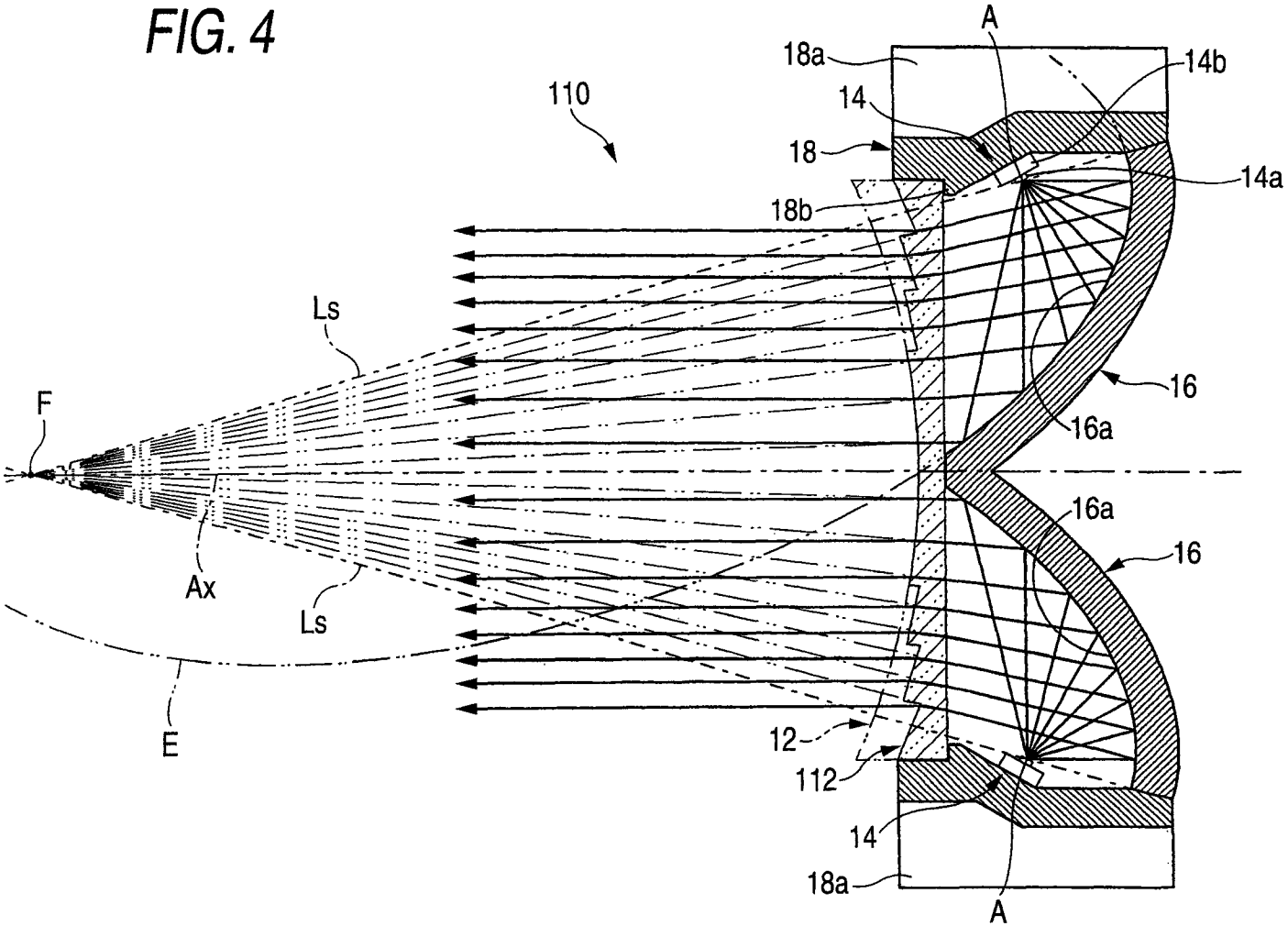
FIG. 4 is a side sectional view showing a vehicle lamp according to a second exemplary embodiment of the present invention.

FIG. 4 is a side sectional view showing a vehicle lamp 110 according to a second exemplary embodiment.

As shown in FIG. 4, the vehicle lamp 110 according to the second exemplary embodiment has a basic structure which is similar to that of the vehicle lamp 10 according to the first exemplary embodiment and is different from that in the first exemplary embodiment in that a concave lens 112 is a Fresnel lens.

Also in the case in which the structure according to the second exemplary embodiment is employed, it is possible to obtain the similar advantages as those in the first exemplary embodiment. By employing the structure according to the second exemplary embodiment, moreover, it is possible to reduce a thickness of the concave lens 112 itself, thereby promoting a reduction in the thickness of the lamp still more.

Third Exemplary Embodiment

Figure 5:
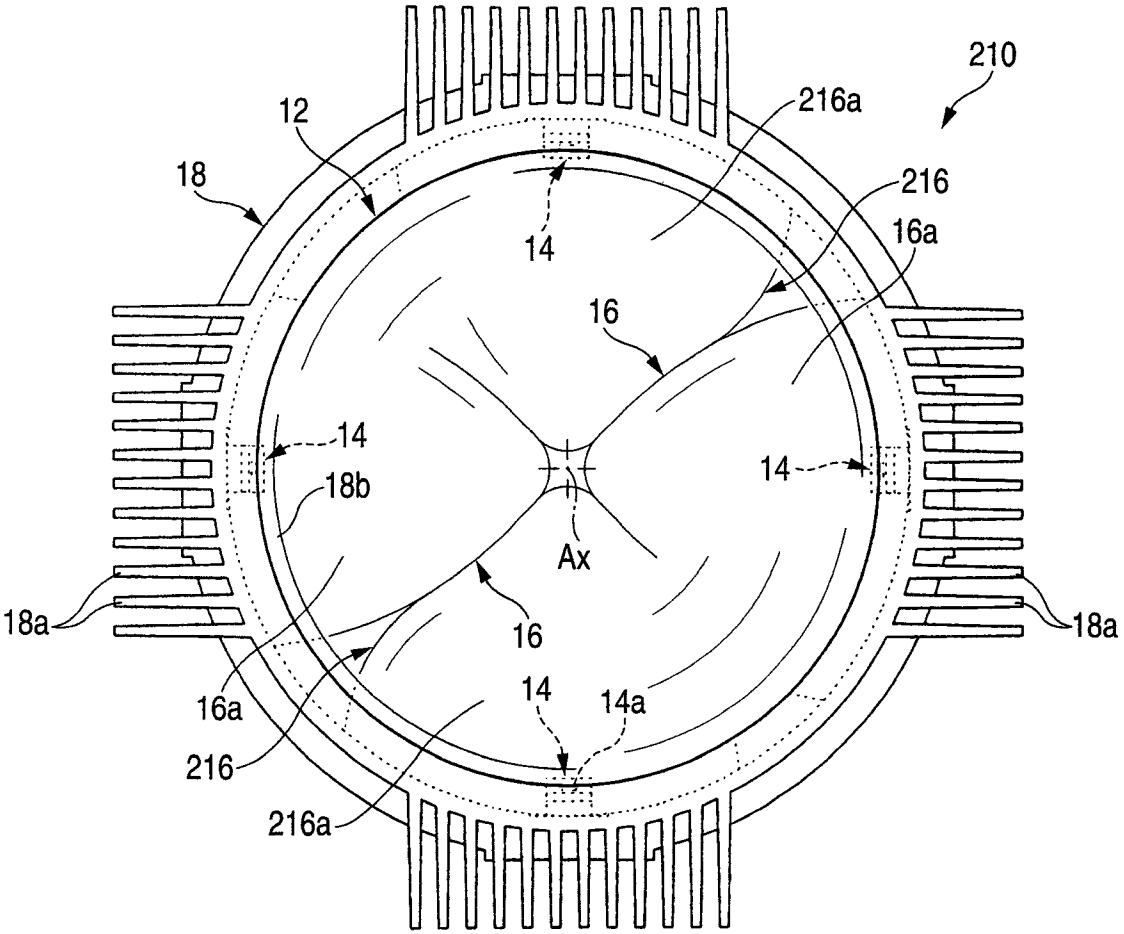
FIG. 5 is a front view showing a vehicle lamp according to a third exemplary embodiment of the present invention.

FIG. 5 is a front view showing a vehicle lamp 210 according to a third exemplary embodiment.

As shown in FIG. 5, the vehicle lamp 210 according to the third exemplary embodiment has a basic structure as that of the vehicle lamp 10 according to the first exemplary embodiment. However, in the vehicle lamp 210, two of the four reflectors, i.e., the upper and lower reflectors 216 shown in FIG. 5, have different structures from those in the first exemplary embodiment.

In other words, structures of the left and right reflectors 16 are the same as those in the first exemplary embodiment. However, for the upper and lower reflectors 216, a shape of a reflecting surface 216*a* is different from that of the first exemplary embodiment.

More specifically, the reflecting surface 216*a* of each of the reflectors 216 has a sectional shape taken along a vertical plane which is formed by the ellipse E as in the first exemplary embodiment, but the sectional shape is a curved surface obtained by slightly enlarging the spheroid of the first exemplary embodiment in a horizontal direction (a right-and-left direction).

Consequently, a light emitted from the light emitting elements 14 associated with the reflecting surfaces 216*a* of the associated reflectors 216 is incident, on a concave lens 12, as a convergent light transmitted toward a front focal point F of the concave lens 12 in the vertical plane, and the light emitted from the concave lens 12 is changed into a light which is parallel with an optical axis Ax. In a horizontal plane, the light is incident on the concave lens 12 at a smaller incident angle than the convergent light transmitted toward the front focal point F of the concave lens 12 and is thus emitted, from the concave lens 12, as a light which is slightly diffused in the horizontal direction.

Figure 6:
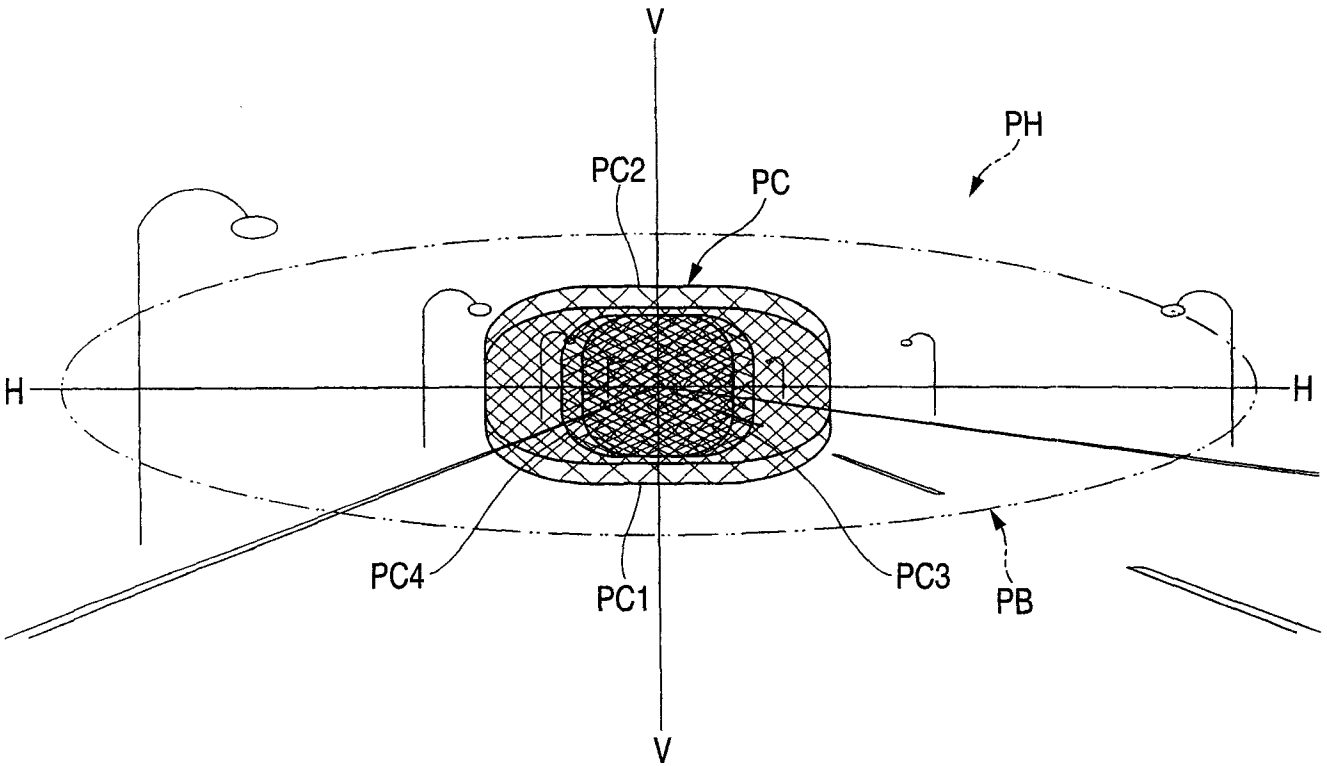
FIG. 6 is a perspective view showing a light distribution pattern of the vehicle lamp of FIG. 5 formed on a virtual vertical screen disposed at a position of 25 m in front of the vehicle lamp by a light irradiated forward from the vehicle lamp.

FIG. 6 is a perspective view showing a light distribution pattern PC from a vehicle lamp 210 according to the third exemplary embodiment of the present invention. The light distribution pattern PC is formed on a virtual vertical screen disposed in a forward position of 25 m by a light irradiated forward from the vehicle lamp 210.

As shown in FIG. 6, the light distribution pattern PC is formed to be slightly oblong around axes H-V and is formed as a part of a light distribution pattern PH for a high beam in a similar manner as in the first exemplary embodiment.

The light distribution pattern PC is formed as a synthetic light distribution pattern of four light distribution patterns PC1, PC2, PC3 and PC4. Each of the light distribution patterns PC1, PC2, PC3 and PC4 is formed by turning ON each of the light emitting elements 14 disposed in upper, lower, left and right positions of the optical axis Ax. In that case, the light distribution patterns PC3 and PC4 take a shape of a spot in a similar manner as the light distribution patterns PA3 and PA4 according to the first exemplary embodiment, and the light distribution patterns PC1 and PC2 are obtained by slightly enlarging the light distribution patterns PA1 and PA2 shown in FIG. 3 with respect to the first exemplary embodiment in a horizontal direction.

The light distribution patterns PC1 and PC2 are slightly enlarged because although all of the light emitted from the light emitting elements 14, transmitted forward from the concave lens 12 and reflected from the reflecting surfaces 16*a* of the left and right reflectors 16 is changed into light which is parallel with the optical axis Ax, the light reflected from the reflecting surfaces 216*a* of the upper and lower reflectors 216 is changed into light which is parallel with the optical axis Ax with respect to a vertical direction and is changed into light which is more diffused in the right-and-left direction with respect to a horizontal direction.

By employing the structure according to the third exemplary embodiment, it is possible to obtain a slightly oblong light distribution pattern as the light distribution pattern PC for forming a hot zone of the light distribution pattern PH for a high beam. Consequently, it is possible to enhance a visibility by widely irradiating a light on a distant region of a forward road surface of the vehicle.

Fourth Exemplary Embodiment

Figure 7:
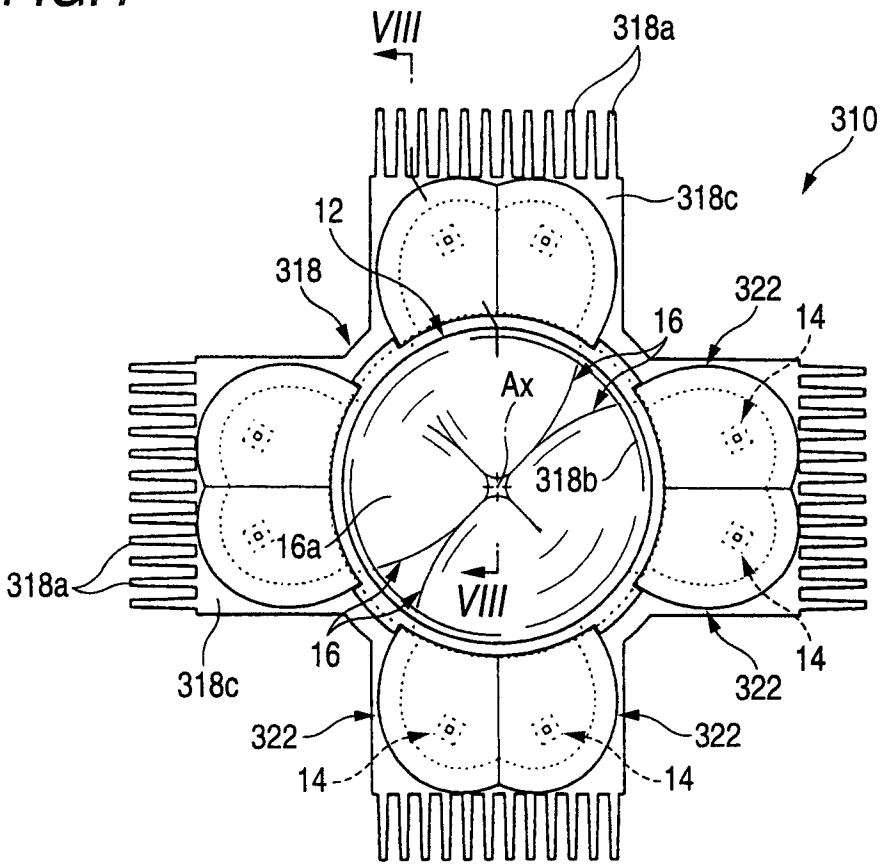
FIG. 7 is a front view showing a vehicle lamp according to a fourth exemplary embodiment of the present invention.
Figure 8:
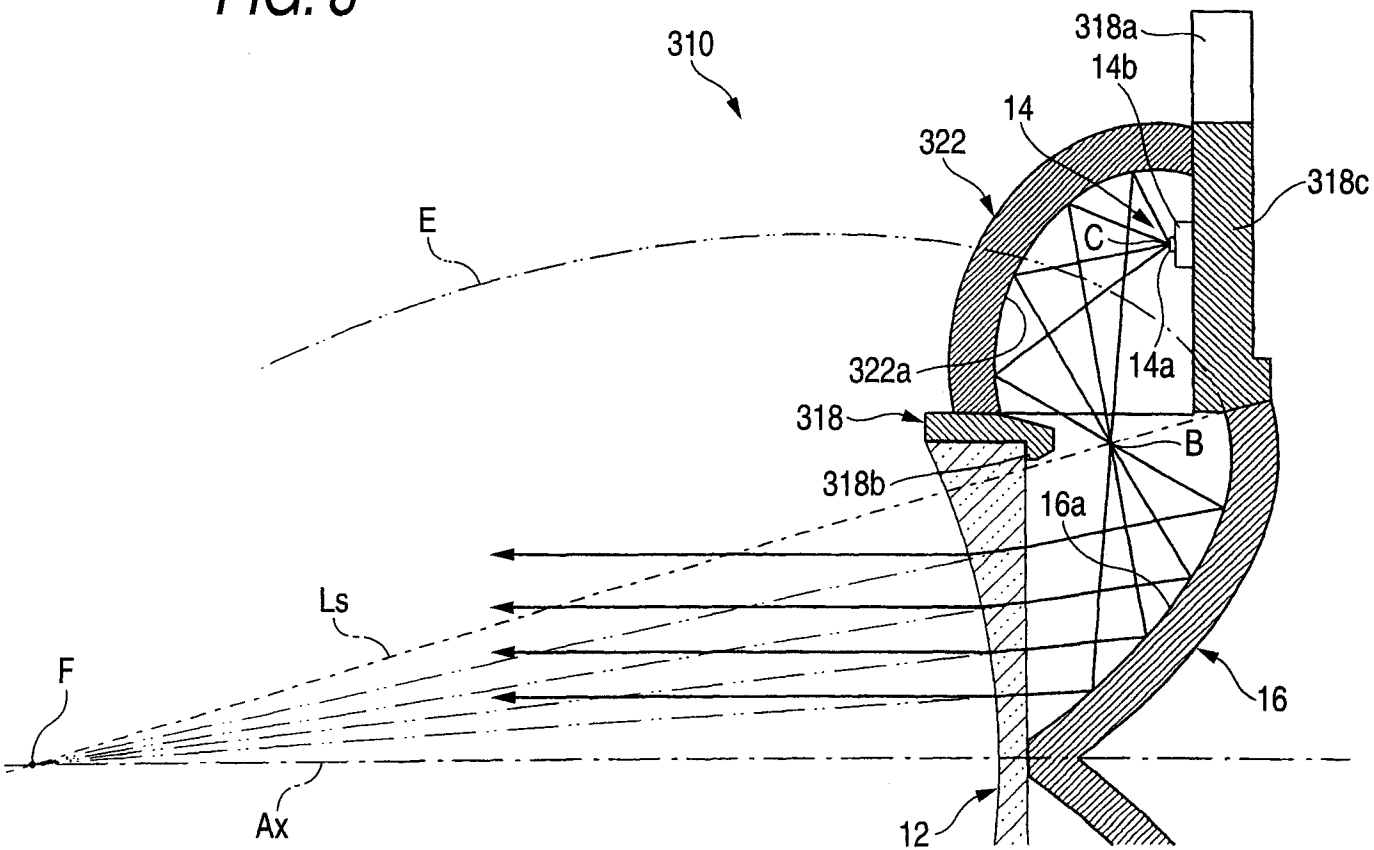
FIG. 8 is a side sectional view showing a part of the vehicle lamp of FIG. 7.

FIG. 7 is a front view showing a vehicle lamp 310 according to a fourth exemplary embodiment of the present invention, and FIG. 8 is a side sectional view part of a part of the vehicle lamp 310 shown in FIG. 7.

As shown in FIGS. 7 and 8, the vehicle lamp 310 according to the fourth exemplary embodiment has a similar basic structure as that of the vehicle lamp 10 according to the first exemplary embodiment. However, the vehicle lamp 310 of the fourth exemplary embodiment is different from that in the first exemplary embodiment in respect to the arrangement of each of the light emitting elements 14, and furthermore, in respect to the addition of a plurality of auxiliary reflectors 322.

More specifically, in the fourth exemplary embodiment, each of the reflectors 16 has a similar structure as that of the first exemplary embodiment. However, where the first exemplary embodiment has four light emitting elements 14, the fourth exemplary embodiment has eight light emitting elements 14. In the fourth exemplary embodiment, there are two light emitting elements 14 for every light emitting element 14 in the first exemplary embodiment. For each quadrant of the vehicle lamp 310, each of the two light emitting elements 14 in the fourth exemplary embodiment are disposed in positions placed apart from an optical axis Ax and apart from a point B which is taken as a point on which a light emitting center A of each of the light emitting elements 14 is positioned in the first exemplary embodiment. These two of the light emitting elements 14 are disposed such that light emitted from each of the light emitting elements 14 is directed in a forward direction (i.e., a direction in which the vehicle lamp 310 is pointing) and at a regular interval from each other in a circumferential direction.

For each quadrant, two auxiliary reflectors 322, i.e., one corresponding to each of the two light emitting elements 14, are formed integrally and are disposed in a vicinity of a forward part of the two light emitting elements 14, respectively. Each of the auxiliary reflectors 322 reflects light emitted from its respective light emitting element 14 such that the light is converged at a point B (i.e., a converging point). In order to implement the structure, an auxiliary reflecting surface 322*a* of each of the auxiliary reflectors 322 is formed by a spheroid in which a light emitting center C of the respective light emitting element 14 is set to be a first focal point and the point B is set to be a second focal point.

In the fourth exemplary embodiment, for each quadrant, the reflector 16 is disposed between the point B and the optical axis Ax. Light which is emitted from the light emitting element 14, is reflected by its auxiliary reflector 322 and is converged once on the point B, and is then incident, on the reflector 16, and a divergent light from the point B is reflected forward by the reflector 16.

In the fourth exemplary embodiment, a lens holder 318 has a shape for fixing and supporting each of the light emitting elements 14 that is partially different from that of the lens holder 18 in the first exemplary embodiment.

More specifically, the lens holder 318 according to the fourth exemplary embodiment is a metallic member formed annularly in a similar manner as the lens holder 18 according to the first exemplary embodiment, and has such a structure as to fix and support a concave lens 12 in a lens support portion 318*b* formed on a front end thereof and to fix and support four reflectors 16 at a rear end thereof, and a plate-shaped light source support portion 318*c* is formed along a plane which is orthogonal to the optical axis Ax in four places in a circumferential direction thereof. In each of the light source support portions 318*c*, i.e., one for each quadrant, the two respective light emitting elements 14 are disposed at a regular interval in the circumferential direction and are fixed and supported in this state, and furthermore, the two respective auxiliary reflectors 322 are also fixed and supported by the respective light source support portion 318*c*.

Also in the lens holder 318, a plurality of radiation fins 318*a* are formed to be protruded toward an outer peripheral side of the light source support portion 318*c* at an end face on the outer peripheral side.

Although a light distribution pattern formed by a light irradiated from the vehicle lamp 310 according to the fourth exemplary embodiment has a similar shape as a light distribution pattern PA formed in the first exemplary embodiment, the light emitted from the light emitting elements 14 is reflected twice, i.e., by the auxiliary reflector 322 and by the reflector 16, and is then incident on the concave lens 12 in the fourth exemplary embodiment. Therefore, each light distribution pattern thus formed has a smaller light distribution unevenness than each of light distribution patterns PA1, PA2, PA3 and PA4 formed in the first exemplary embodiment.

In addition, in the vehicle lamp 310 according to the fourth exemplary embodiment, two light emitting elements 14 and two auxiliary reflectors 322 are disposed for every reflector 16 and the light emitted from the light emitting elements 14 is converged on the point B. Therefore, it is possible to attain a reduction in a thickness of the lamp, thereby increasing an amount of an irradiated light still more. Consequently, it is possible to form a brighter light distribution pattern using the vehicle lamp 310 of the fourth exemplary embodiment than the light distribution pattern PA formed using the vehicle lamp 10 of the first exemplary embodiment.

As an alternative to the structure in which two light emitting elements 14 and two auxiliary reflectors 322 are disposed, it is also possible to employ a structure in which only one light emitting element 14 and one auxiliary reflector 322 is disposed in each quadrant of the vehicle lamp 310.

Fifth Exemplary Embodiment

Figure 9:
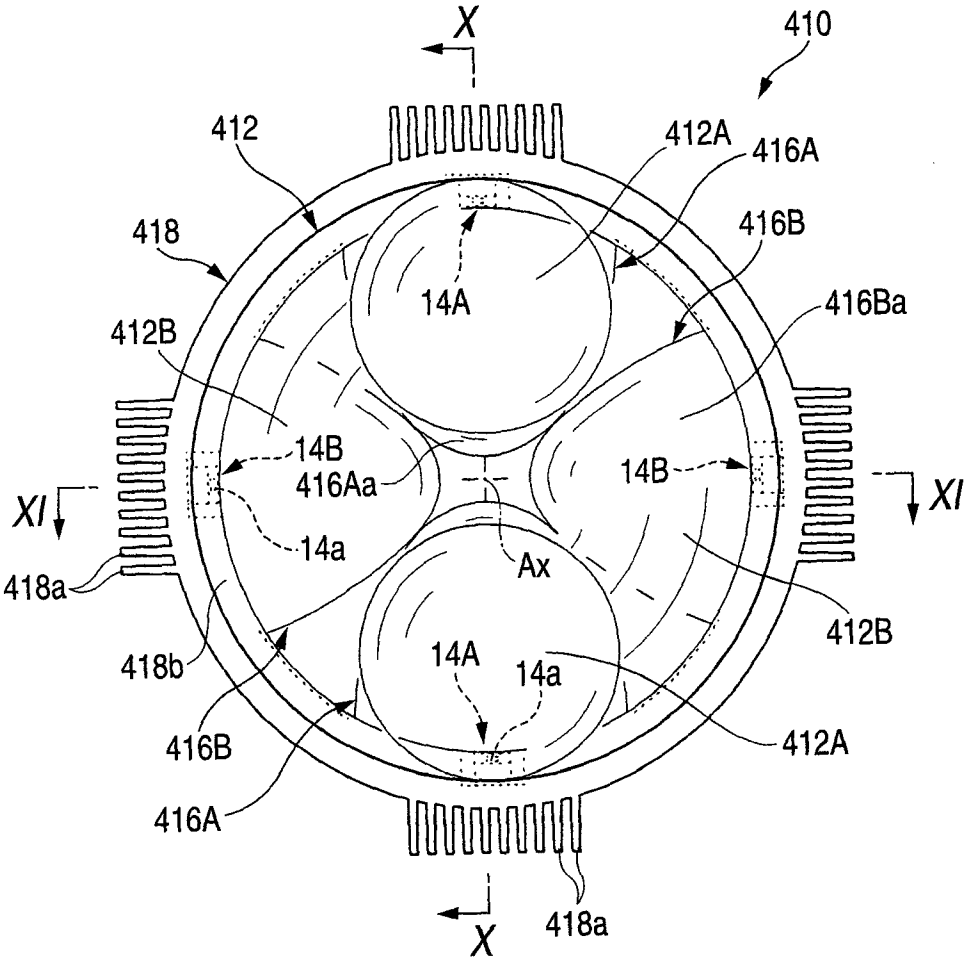
FIG. 9 is a front view showing a vehicle lamp according to a fifth exemplary embodiment of the present invention.
Figure 10:
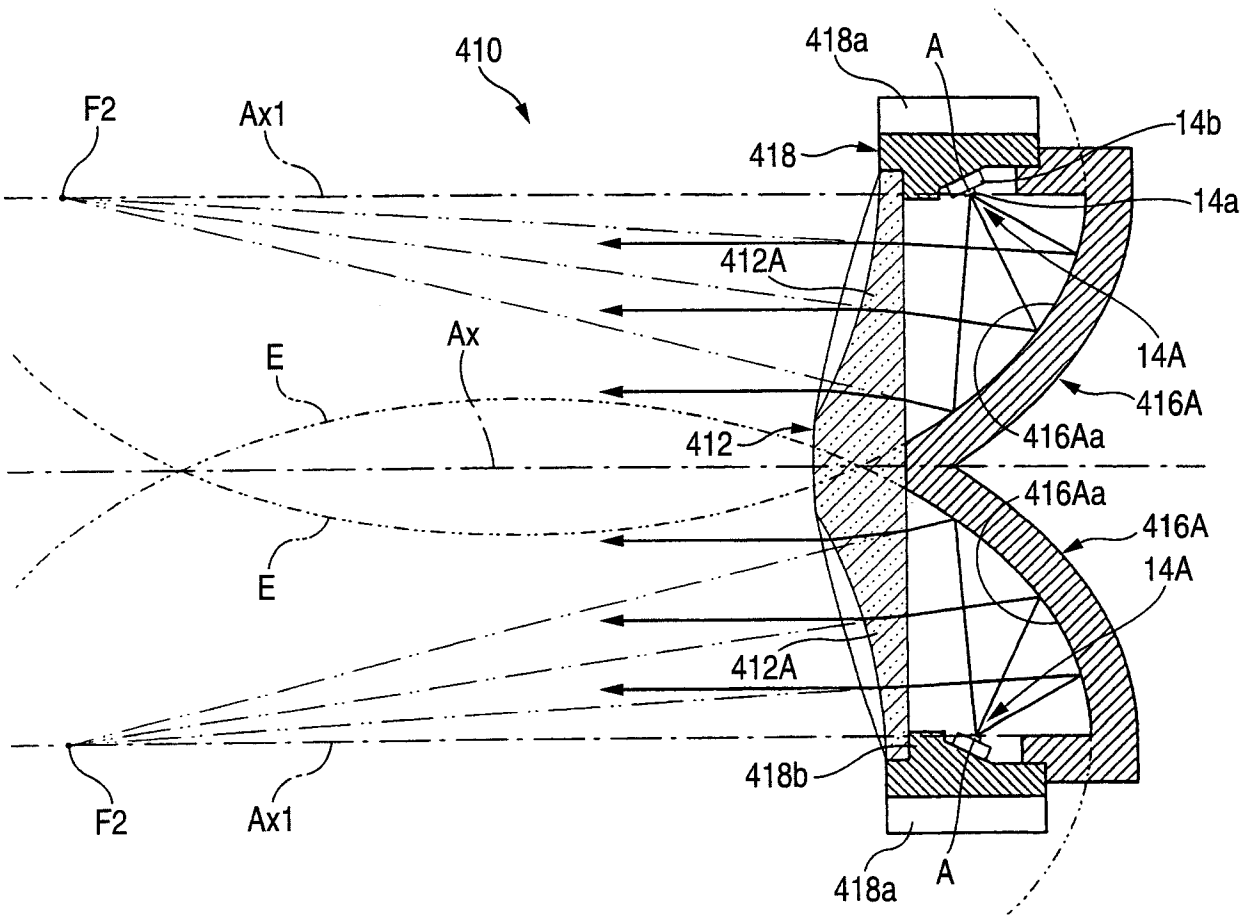
FIG. 10 is a sectional view taken along the line X-X in FIG. 9.
Figure 11:
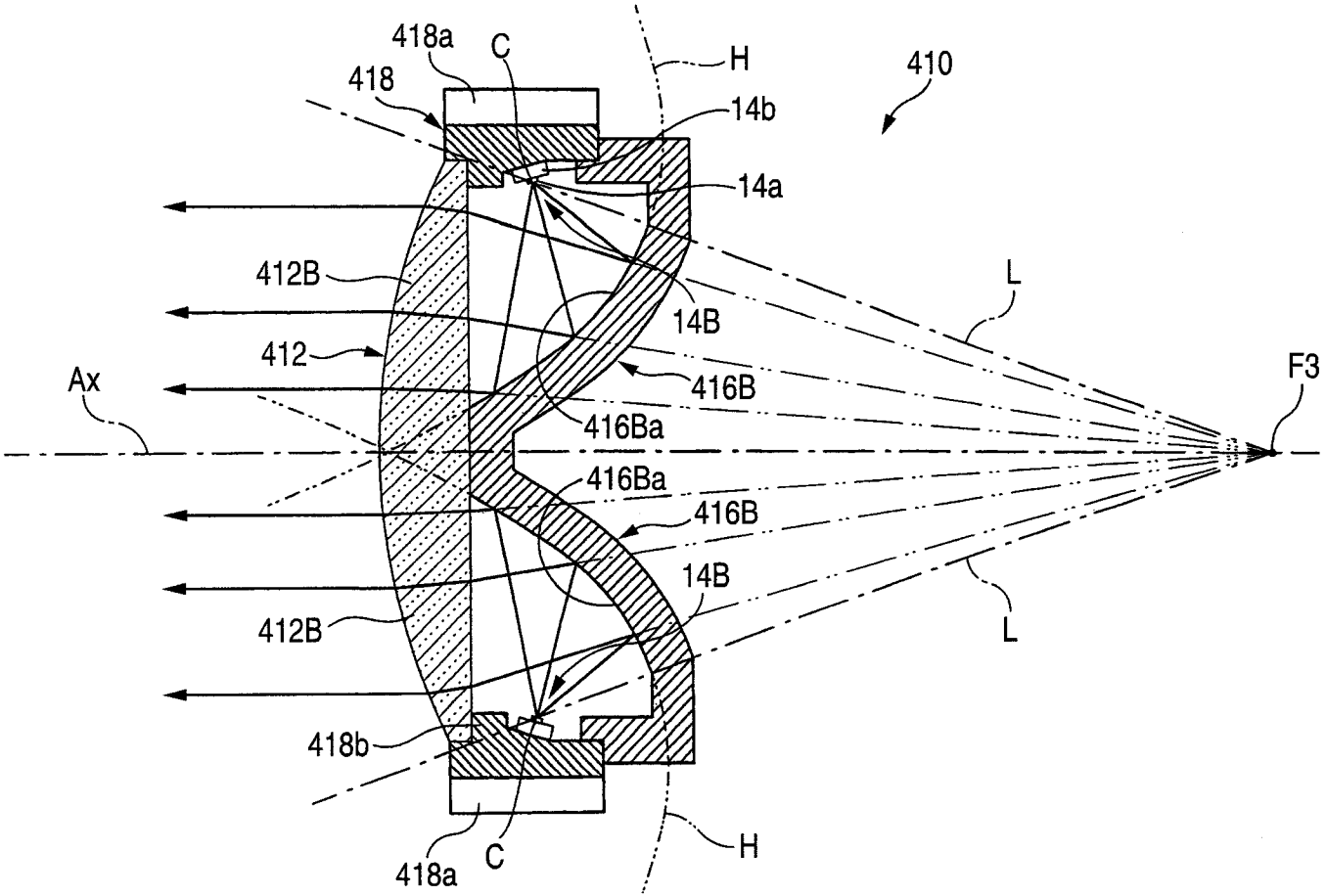
FIG. 11 is a sectional view taken along the line XI-XI in FIG. 9.

As shown in FIGS. 9, 10, and 11, the vehicle lamp 410 according to a fifth exemplary embodiment includes a convex lens 412 disposed on an optical axis Ax extending in a front-and-rear direction of the lamp 410, four light emitting elements 14A, 14B disposed behind the convex lens 412, four reflectors 416A, 416B, and a lens holder 418. The vehicle lamp 410 is used as a lamp unit of a vehicle headlamp in a state in which it is incorporated to enable a regulation of the optical axis for a lamp body (not shown). In such a case, the vehicle lamp 410 serves to irradiate light for forming a part of a high beam light distribution pattern in a state in which the optical axis Ax is disposed to be extended in a front-and-rear direction of the vehicle.

Figure 12:
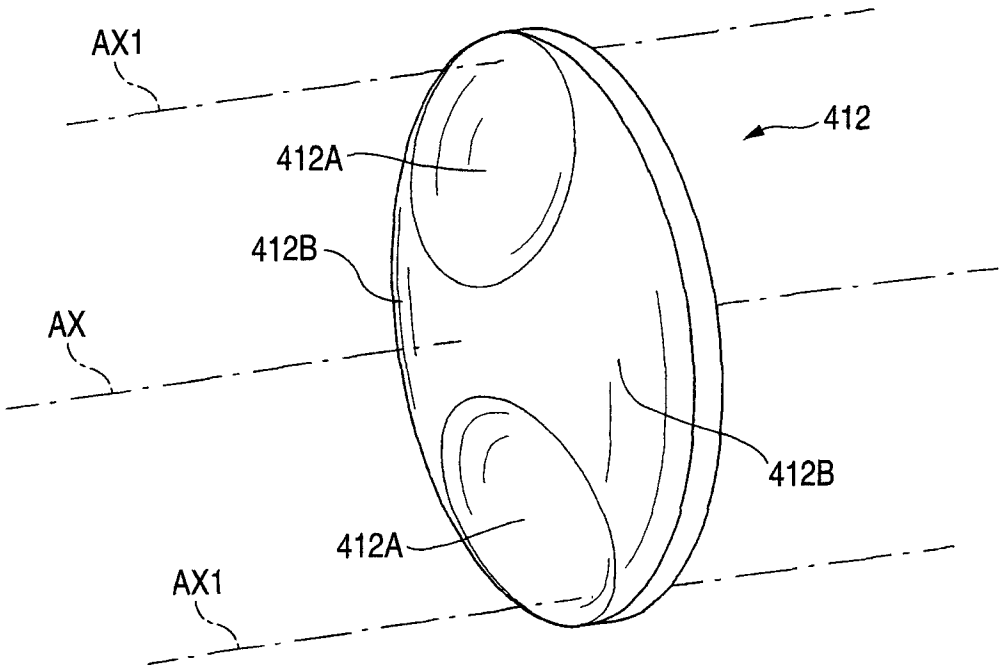
FIG. 12 is a perspective view showing, as a single product, a convex lens of the vehicle lamp of FIG. 9.

FIG. 12 is a perspective view showing the convex lens 412 as a single product.

As shown in FIGS. 9, 10, 11, and 12, the convex lens 412 is a planoconvex aspherical lens in which a front side surface is a convex surface and a rear side surface is a plane, and is fixed and supported onto the lens holder 418 in a peripheral edge portion thereof. The lens holder 418 is a metallic member formed annularly and a lens support portion 418*b* for fixing and supporting the convex lens 412 is formed on an inner peripheral surface of a front end thereof. An effective diameter of the convex lens 412 is defined by an inside diameter of the lens support portion 418*b*. The convex lens 412 has a relative aperture (i.e., a focal ratio, a ratio of the effective diameter of the convex lens 412 to a focal length thereof) set to have a value which is less than or equal to one (more specifically, a value of approximately 0.6).

Two places in a circumferential direction with the optical axis Ax in the convex lens 412 set to be a center are formed as concave lens portions 412A. The concave lens portions 412A in the two places are disposed just above and below the optical axis Ax.

The concave lens portions 412A are formed by scraping a surface of the convex lens 412 to take an almost spherical shape and have a substantially circular shape as seen from a front of the lamp. Each of the concave lens portions 412A is disposed so as to be inscribed on an outer peripheral edge of the convex lens 412 in a position placed apart from the optical axis Ax.

Each of the concave lens portions 412A has, as an optical axis Ax1. The optical axis Ax1 is parallel with the optical axis Ax and passes through a vicinal portion of an outer peripheral edge of the convex lens 412, and a focal length thereof is set to have a substantially equal value to that of the convex lens 412.

The four light emitting elements 14A, 14B are disposed at a regular interval on a same circumference around the optical axis Ax between the convex lens 412 and a rear focal point F3 of the convex lens 412 (see FIG. 11). More specifically, the light emitting elements 14A, 14B are disposed in positions placed behind the outer peripheral edge of the convex lens 412 in the vicinity of a rear part of the convex lens 412.

Two of the four light emitting elements 14A, 14B are disposed as first light emitting elements 14A in the vicinity of a rear part of the outer peripheral edge of the convex lens 412 in positions placed above and below the optical axis Ax (that is, between each of the concave lens portions 412A and a rear focal point of the concave lens portion 412A, more specifically, in the vicinity of the rear part of the concave lens portion 412A) (see FIG. 10), and the residual two of the four light emitting elements 14A, 14B are disposed as second light emitting elements 14B in the vicinity of the rear part of the outer peripheral edge of the convex lens 412 in positions placed beside both left and right sides of the optical axis Ax (that is, in the vicinity of a rear part of a circumferentially-intermediate portion 412B which is positioned between the concave lens portions 412A in the convex lens 412) (see FIG. 11).

The light emitting elements 14A, 14B are white light emitting diodes, and each comprises a light emitting chip 14*a* having a light emitting surface in a size of approximately 1 mm square and a substrate 14*b* for supporting the light emitting chip 14*a*. In such a case, the light emitting chip 14*a* is sealed with a thin film formed to cover a light emitting surface thereof. The light emitting elements 14A, 14B are fixed and supported onto an inner peripheral surface of the lens holder 418 in a state in which the light emitting chip 14*a* is tilted slightly rearward toward the optical axis Ax (more specifically, a state in which the light emitting chip 14*a* is tilted by approximately 10 to approximately 30 degrees rearward with respect to an orthogonal direction to the optical axis Ax).

A plurality of radiation fins 418*a* is formed to be protruded toward an outer peripheral side in a portion positioned on the outer peripheral side from the light emitting elements 14A, 14B with respect to the optical axis Ax in the lens holder 418.

Two of the four reflectors 416A, 416B are disposed as first reflectors 416A to cover the respective first light emitting elements 14A like a semidome between the first light emitting elements 14A and the optical axis Ax, and serve to forward reflect light emitted from the first light emitting elements 14A. Moreover, the residual two of the four reflectors 416A, 416B are disposed as second reflectors 416B to cover the respective second light emitting elements 14B like a semidome between the second light emitting elements 14B and the optical axis Ax, and serve to forward reflect light emitted from the second light emitting elements 14B. The four reflectors 416A, 416B are formed integrally with each other and are fixed and supported onto a rear end of the lens holder 418. Each of the reflectors 416A, 416B is formed in such a manner that a front edge thereof is extended to a surface at a rear side of the convex lens 412.

Reflecting surfaces 416Aa of the corresponding first reflectors 416A take a sectional shape along a plane including a light emitting center A of the respective first light emitting element 14A and the optical axis Ax which is formed by an ellipse E setting the light emitting center A of the respective first light emitting element 14A to be a first focal point and a front focal point F2 of the concave lens portion 412A to be a second focal point (that is, a coaxial segment with the optical axis Ax1 is set to be a major axis). In the fifth exemplary embodiment, each of the reflecting surfaces 416Aa of the respective first reflectors 416A is a spheroid surface formed by rotating the ellipse E around the major axis.

Each of the first light emitting elements 14A is disposed with the light emitting chip 14*a* tilted to a slightly rear side toward the optical axis Ax. Therefore, for each of the first light emitting elements 14A, most of the light emitted from the first light emitting element 14A is incident on the respective reflecting surface 416Aa of the respective first reflector 416A and is reflected forward by the respective reflecting surface 416Aa, and is thus incident on the concave lens portion 412A. In that case, the first reflecting surface 416Aa of the reflector 416A is a spheroid surface. Therefore, all of the light emitted from the first light emitting elements 14A and reflected by the respective reflecting surfaces 416Aa are incident, on the concave lens portion 412A, as convergent lights transmitted toward the front focal point F2 of the concave lens portion 412A. Thus, all of the light emitted from the first light emitting elements 14A and transmitted forward from the concave lens portions 412A is parallel with the optical axis Ax.

On the other hand, for each of the second light emitting elements 14B, a reflecting surface 416Ba of the respective second reflector 416B takes a sectional shape taken along a plane including a light emitting center C of the respective second light emitting element 14B and the optical axis Ax which is formed by a hyperbola H on the second focal point side in a pair of hyperbolas in which the rear focal point F3 of the convex lens 412 is set to be a first focal point and the light emitting center C of the respective second light emitting element 14B is set to be a second focal point (that is, a straight line L connecting the rear focal point F3 and the light emitting center C is set to be an axis). In the fifth exemplary embodiment, each of the reflecting surfaces 416Ba of the respective second reflectors 416B has a shape of a hyperboloid of revolution which is formed by rotating the hyperbola H around the axis.

Each of the second light emitting elements 14B is disposed with the light emitting chip 14*a* tilted to a slightly rear side toward the optical axis Ax. Therefore, for each of the second light emitting elements 14B, most of the light emitted from the respective second light emitting element 14B is incident on the respective reflecting surface 416Ba of the respective second reflector 416B and is reflected forward by the reflecting surface 416Ba, and is thus incident on the circumferentially-intermediate portion 412B of the convex lens 412. Thus, the reflecting surface 416Ba of the respective second reflector 416B is the hyperboloid of revolution. Therefore, the lights emitted from the second light emitting elements 14B and reflected by the respective reflecting surfaces 416Ba are incident on the circumferentially-intermediate portion 412B of the convex lens 412 through the same optical path as that for a divergent light transmitted from the rear focal point F3 of the convex lens 412. Thus, all of the light emitted from the second light emitting elements 14B and transmitted forward from the circumferentially-intermediate portions 412B is parallel with the optical axis Ax.

Figure 13:
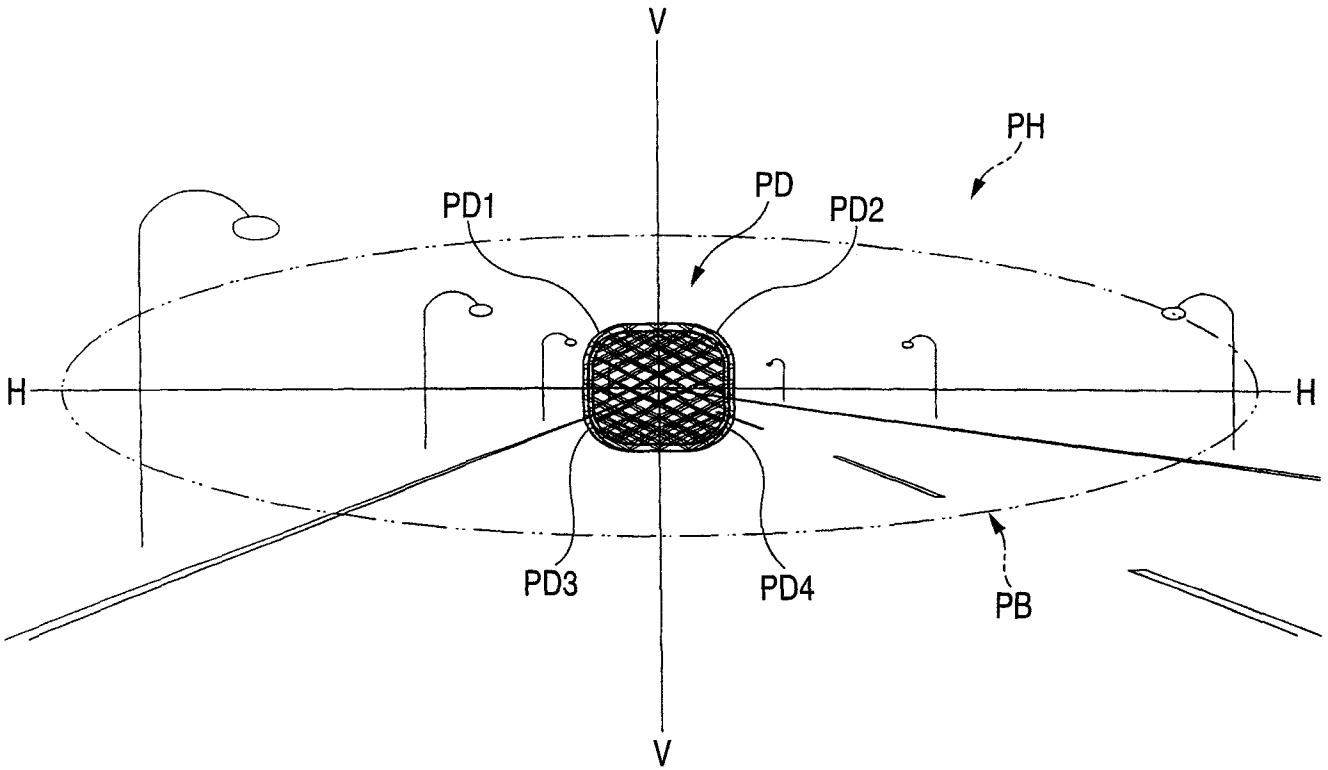
FIG. 13 is a perspective view showing a light distribution pattern formed on a virtual vertical screen disposed at a position of 25 m in front of the vehicle lamp of FIG. 9 by a light irradiated forward from the vehicle lamp.

FIG. 13 is a perspective view showing a light distribution pattern PD of the vehicle lamp 410 according to the fifth exemplary embodiment of the present invention. The light distribution pattern PD is formed on a virtual vertical screen disposed in a forward position of 25 m from the vehicle lamp 410.

As shown in FIG. 13, the light distribution pattern PD takes a shape of a spot which is formed around axis H-V to be a vanishing point in a front direction of the lamp and is formed as a part of a light distribution pattern PH for a high beam. More specifically, the light distribution pattern PH for a high beam is formed as a synthetic light distribution pattern of the light distribution pattern PD and a diffused light distribution pattern PB formed by a light irradiated forward from another lamp which is not shown, and a hot zone to be a high luminous intensity region is formed by the light distribution pattern PD.

The light distribution pattern PD is formed as a synthetic light distribution pattern of four light distribution patterns PD1, PD2, PD3 and PD4. Two light distribution patterns PD1 and PD2 are formed by turning ON each of two first light emitting elements 14A, respectively, and the two residual light distribution patterns PD3 and PD4 are formed by turning ON the two residual second light emitting elements 14B, respectively. All of the light distribution patterns PD1, PD2, PD3 and PD4 take a shape of a spot since all of the light emitted from the light emitting elements 14A, 14B and transmitted forward from the convex lens 412 is parallel with the optical axis Ax.

As described above in detail, the vehicle lamp 410 according to the fifth exemplary embodiment has such a structure comprising the convex lens 412 disposed on the optical axis Ax extending in the front-and-rear direction of the lamp and the four light emitting elements 14A, 14B disposed behind the convex lens 412. Two places in the circumferential direction around the optical axis Ax in the convex lens 412 are formed as the concave lens portions 412A. Moreover, the four light emitting elements 14A, 14B are disposed at a regular interval in the circumferential direction around the optical axis Ax. Two of them are disposed as the first light emitting elements 14A in the vicinity of the rear part of the concave lens portions 412A respectively, and furthermore, a residual two of them are disposed as the second light emitting elements 14B in the vicinity of the rear part of the circumferentially-intermediate portion 412B which is disposed between the concave lens portions 412A in the convex lens 412 respectively. Moreover, the first reflectors 416A for forward reflecting the light emitted from the respective first light emitting elements 14A are disposed between the first light emitting elements 14A and the optical axis Ax respectively, and furthermore, the second reflectors 416B for forward reflecting the light emitted from the respective second light emitting elements 14B are disposed between the second light emitting elements 14B and the optical axis Ax respectively. Therefore, for each of the first light emitting elements 14A, the light which is emitted from the first light emitting element 14A and is incident on the first reflector 416A is reflected by the first reflector 416A and is incident on the concave lens portion 412A, and is then deflected and controlled by the concave lens portion 412A and is transmitted forward, and for each of the second light emitting elements 14B, the light which is emitted from the second light emitting element 14B and is incident on the second reflector 416B is reflected by the second reflector 416B and is incident on the circumferentially-intermediate portion 412B of the convex lens 412, and is then deflected and controlled by the convex lens 412 and is transmitted forward.

In that case, the sectional shape of the reflecting surface 416Aa of each of the first reflectors 416A which is taken along the plane including the light emitting center A of the respective first light emitting element 14A and the optical axis Ax is formed by the ellipse E in which the light emitting center A of the respective first light emitting element 14A is set to be the first focal point and the front focal point F2 of the concave lens portion 412A is set to be the second focal point. Therefore, the light reflected by the first reflectors 416A are incident, on the concave lens portion 412A, as convergent lights to be transmitted toward the second focal point of the ellipse E in the plane. Since the second focal point is positioned on the front focal point F2 of the concave lens portion 412A, the light emitted from the concave lens portion 412A is changed into a light which is parallel with the optical axis Ax in at least the plane. Consequently, it is possible to carry out a light distribution control with high precision.

Moreover, the sectional shape of the reflecting surface 416Ba of each of the second reflectors 416B which is taken along the plane including the light emitting center C of the respective second light emitting element 14B and the optical axis Ax is formed by the hyperbola H on the second focal point side in the pair of hyperbolas in which the rear focal point F3 of the convex lens 412 is set to be the first focal point and the light emitting center C of the respective second light emitting element 14B is set to be the second focal point. Therefore, the light reflected from the second reflector 416B is incident, as a divergent light transmitted from the first focal points of the pair of hyperbolas, on the circumferentially-intermediate portion 412B of the convex lens 412 in the plane. Since the first focal point is positioned on the rear focal point F3 of the convex lens 412, the light emitted from the circumferentially-intermediate portion 412B is changed into a light which is parallel with the optical axis Ax in at least the plane. Consequently, it is possible to carry out a light distribution control with high precision.

The first light emitting elements 14A and their respective first reflectors 416A, and the second light emitting elements 141 and their second reflectors 416B are disposed in the vicinity of the rear part of the convex lens 412. As compared with the structure of the lamp in which the light emitting element is disposed in the vicinity of the rear focal point of the convex lens 412 as in the related art, therefore, it is possible to reduce a length of the vehicle lamp 410. By turning ON the four light emitting elements 14A, 14B, it is possible to ensure a sufficient amount of an irradiated light.

According to the fifth exemplary embodiment, in the vehicle lamp 410 using the light emitting elements 14A, 14B as light sources, it is thus possible to carry out a light distribution control with high precision, thereby reducing a thickness of the vehicle lamp and ensuring a sufficient amount of an irradiated light. By reducing the thickness of the vehicle lamp, thus, it is possible to enhance a degree of freedom of a layout of the vehicle lamp.

In the vehicle lamp 410 according to the fifth exemplary embodiment, moreover, the concave lens portions 412A are disposed on both upper and lower sides of the optical axis Ax (that is, portions having symmetrical shapes in the convex lens 412). Therefore, it is easy to carry out the light distribution control.

In addition, in the vehicle lamp 410 according to the fifth exemplary embodiment, the reflecting surfaces 416Aa of the respective first reflectors 416A have a shape of the spheroid, and furthermore, the reflecting surfaces 416Ba of the respective second reflectors 416B have a shape of the hyperboloid of revolution. Therefore, all of the light emitted from the light emitting elements 14A, 14B and transmitted forward from the convex lens 412 are changed into lights which are parallel with the optical axis Ax. By turning ON the light emitting elements 14A, 14B, consequently, it is possible to form the spot-like light distribution patterns PD1, PD2, PD3 and PD4 in the direction of the front face of the lamp. If the four light emitting elements 14A, 14B are turned ON at the same time, the light distribution pattern PD is formed as the synthetic light distribution pattern of the four light distribution patterns PD1, PD2, PD3 and PD4.

In the vehicle lamp 410 according to the fifth exemplary embodiment, moreover, the relative aperture of the convex lens 412 is set to have a value which is equal to or smaller than one, that is, approximately 0.6. Therefore, it is possible to form the convex lens 412 to be comparatively thin. In addition, the relative aperture of the concave lens portion 412A has a smaller value. Therefore, an angle formed by the direction of the lights emitted from the light emitting elements 14A, 14B and reflected by the reflectors 416A, 416B with the optical axis Ax1 can be reduced to have a comparatively small value. Consequently, the deflecting control for the light reflected from the reflectors 416A, 416B can be carried out with high precision.

In the vehicle lamp 410 according to the fifth exemplary embodiment, furthermore, each of the light emitting elements 14A, 14B is supported on the metallic lens holder 418 and the radiation fins 418*a* are formed in the portion of the lens holder 418 which is positioned on the outer peripheral side of the light emitting element 14 with respect to the optical axis Ax. Therefore, it is possible to move heat generated by an ON operation of the light emitting elements 14A, 14B by a heat conducting function to the lens holder 418 which has a larger heat capacity to more efficiently dissipate the heat from the radiation fins 418*a*. The radiation fins 418*a* are positioned on the outer peripheral side of the respective light emitting elements 14A, 14B. Therefore, it is possible to maintain the lamp to be thin, thereby obtaining the functions and advantages. In addition, the four light emitting elements 14A, 14B are supported on the common lens holder 418. Therefore, it is possible to sufficiently increase a radiating efficiency and to enhance positioning precision in each of the light emitting elements 14A, 14B.

Although the description has been given on the assumption that each of the light emitting elements 14A, 14B is disposed in the tilting direction by approximately 10 to approximately 30 degrees toward the rear side with respect to the orthogonal direction to the optical axis Ax in the fifth exemplary embodiment, it is also possible to employ a structure in which the other inclination angles are set or a structure in which each of the light emitting elements 14A, 14B is disposed in the orthogonal direction to the optical axis Ax.

While the description has been given on the assumption that the four light emitting elements 14A, 14B are disposed at the regular interval on the same circumference around the optical axis Ax in the fifth exemplary embodiment, moreover, it is also possible to employ a structure in which the four light emitting elements 14A, 14B are disposed in positions shifted from the same circumference or a structure in which they are disposed at an irregular interval in a circumferential direction.

While there has been employed the structure in which two first light emitting elements 14A and two second light emitting elements 14B are disposed to make pairs around the optical axis Ax in the fifth exemplary embodiment, it is also possible to employ a structure in which three or more first light emitting elements 14A and three or more second light emitting elements 14B may be disposed to make pairs.

While the description has been given on the assumption that the ellipse E forming the sectional shape of the reflecting surface 416Aa of the first reflector 416A which is taken along the plane including the optical axis Ax sets the light emitting center A of the first light emitting element 14A to be the first focal point and the front focal point F2 of the concave lens portion 412A to be the second focal point in the fifth exemplary embodiment, the light emitted from the first light emitting element 14A and transmitted forward from the concave lens portion 412A is changed into light which is almost parallel with the optical axis Ax if the first and second focal points are positioned in the vicinity of the light emitting center A and the front focal point F2 respectively. Therefore, it is possible to obtain similar advantages as those in the fifth exemplary embodiment.

Although the description has been given on the assumption that the hyperbola H forming the sectional shape of the reflecting surface 416Ba of the second reflector 416B which is taken along the plane including the light emitting center C of the second light emitting element 14B and the optical axis Ax sets the rear focal point F3 of the convex lens 412 to be the first focal point and sets the light emitting center C of the second light emitting element 14B to be the second focal point, similarly, the light emitted from the second light emitting element 14B and transmitted forward from the circumferentially-intermediate portion 412B is changed into the light which is almost parallel with the optical axis Ax if the first and second focal points are positioned in the vicinity of the rear focal point F3 and the light emitting center C respectively. Therefore, it is possible to obtain similar advantages as those in the fifth exemplary embodiment.

Sixth Exemplary Embodiment

Figure 14:
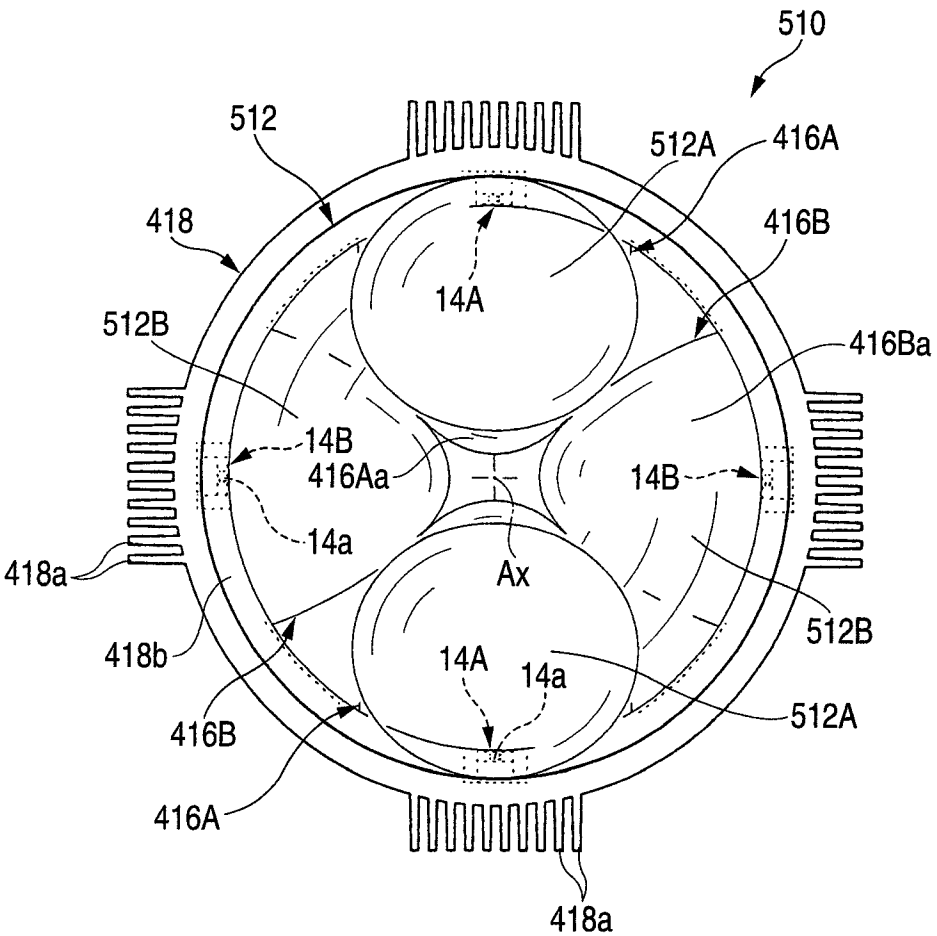
FIG. 14 is a front view showing a vehicle lamp according to a sixth exemplary embodiment of the present invention.

FIG. 14 is a front view showing a vehicle lamp 510 according to a sixth exemplary embodiment of the present invention.

As shown in FIG. 14, the vehicle lamp 510 according to the sixth exemplary embodiment has a basic structure which is similar to the vehicle lamp 410 according to the fifth exemplary embodiment. However, the vehicle lamp 510 is different from that in the fifth exemplary embodiment with respect to a structure of each concave lens portion 512A in a convex lens 512.

More specifically, each of the concave lens portions 512A has a focal length in a horizontal plane which is set to have a different value from a focal length in a vertical plane. More specifically, the focal length in the vertical plane of each of the concave lens portions 512A is equal to that of the convex lens 412 according to the fifth exemplary embodiment and the focal length in the horizontal plane is set to have a greater value than that of the convex lens 412 according to the fifth exemplary embodiment. Thus, each of the concave lens portions 512A takes an almost elliptical shape which is oblong as seen from a front of the lamp. Consequently, a light emitted from the concave lens portion 512A is changed into an almost parallel light in a vertical direction and a slightly diffused light in a horizontal direction.

Figure 15:
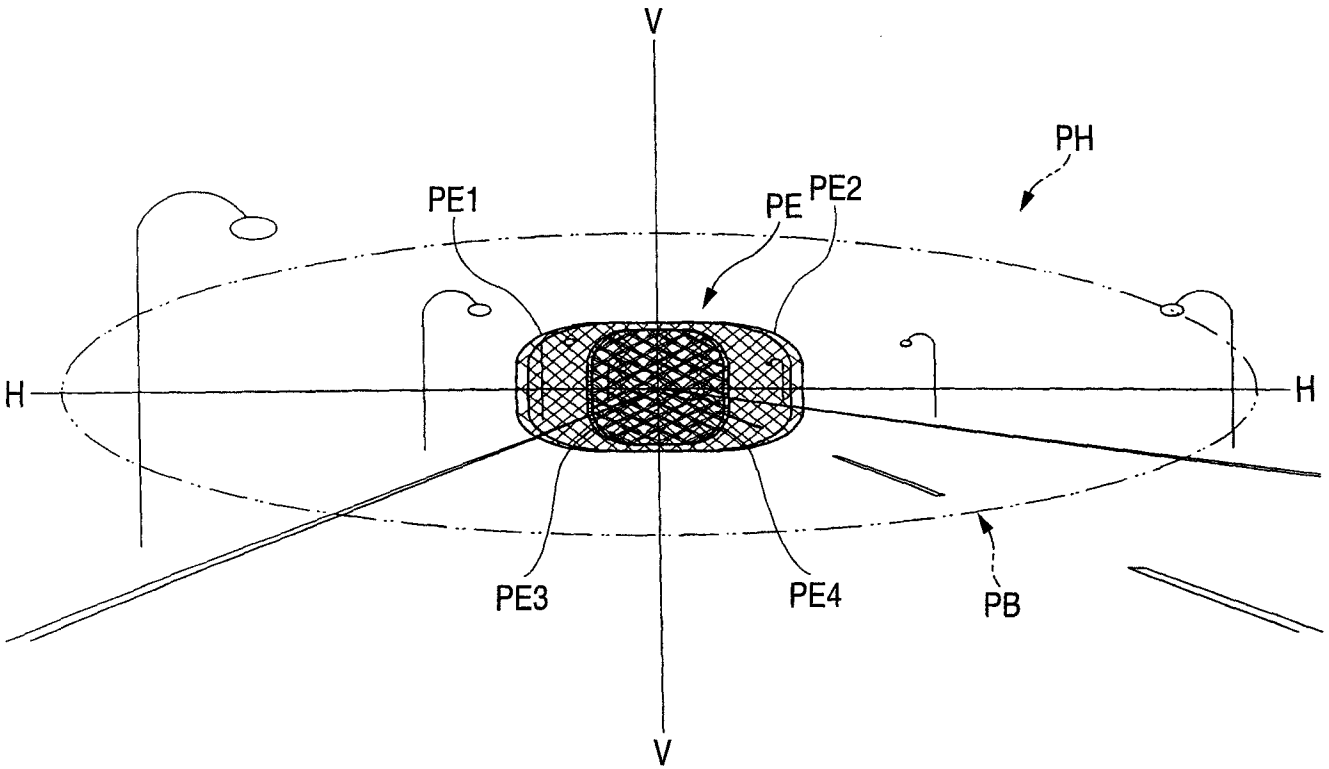
FIG. 15 is a perspective view showing a light distribution pattern formed on a virtual vertical screen disposed at a position of 25 m in front of the vehicle lamp by a light irradiated forward from the vehicle lamp of FIG. 14.

FIG. 15 is a perspective view showing a light distribution pattern PE of the vehicle lamp 510 according to the sixth exemplary embodiment of the present invention. The light distribution pattern PE is formed on a virtual vertical screen disposed in a forward position of 25 m from the vehicle lamp 510 by a light irradiated forward from the lamp 510.

As shown in FIG. 15, the light distribution pattern PE is formed to be slightly oblong around axis H-V and is formed as a part of a light distribution pattern PH for a high beam in a similar manner as in the fifth exemplary embodiment.

The light distribution pattern PE is formed as a synthetic light distribution pattern of four light distribution patterns PE1, PE2, PE3 and PE4. Two light distribution patterns PE1 and PE2 are formed by light emitted from first light emitting elements 14A and transmitted from the concave lens portions 512A in the convex lens 512 and two residual light distribution patterns PE3 and PE4 are formed by light emitted from second light emitting elements 14B and transmitted from a circumferentially-intermediate portion 512B of the convex lens 512. In that case, the light distribution patterns PE3 and PE4 take a shape of a spot in a similar manner as the light distribution patterns PD3 and PD4 according to the fifth exemplary embodiment, and the light distribution patterns PE1 and PE2 are obtained by slightly enlarging the light distribution patterns PD1 and PD2 according to the fifth exemplary embodiment in a horizontal direction.

This is based on the fact that all of the light emitted from the circumferentially-intermediate portions 512B is changed into light which is parallel with an optical axis Ax, while the light emitted from the concave lens portions 512A is changed into a light which is parallel with the optical axis Ax in a vertical direction and a light which is diffused in a right-and-left direction in a horizontal direction.

By employing the structure according to the sixth exemplary embodiment, the light emitted from the concave lens portions 512A is almost parallel light in the vertical direction and a diffused light in the horizontal direction irrespective of a reflecting surface 416Aa of a first reflector 416A which is formed by a simple spheroid. Consequently, it is possible to easily form the light distribution patterns PE1 and PE2 which are oblong.

Consequently, it is possible to obtain a slightly oblong light distribution pattern as the light distribution pattern PE for forming a hot zone of the light distribution pattern PH for a high beam. Thus, it is possible to enhance a visibility by widely irradiating a light on a distant region of a road surface in a forward direction of a vehicle.

Seventh Exemplary Embodiment

Figure 16:
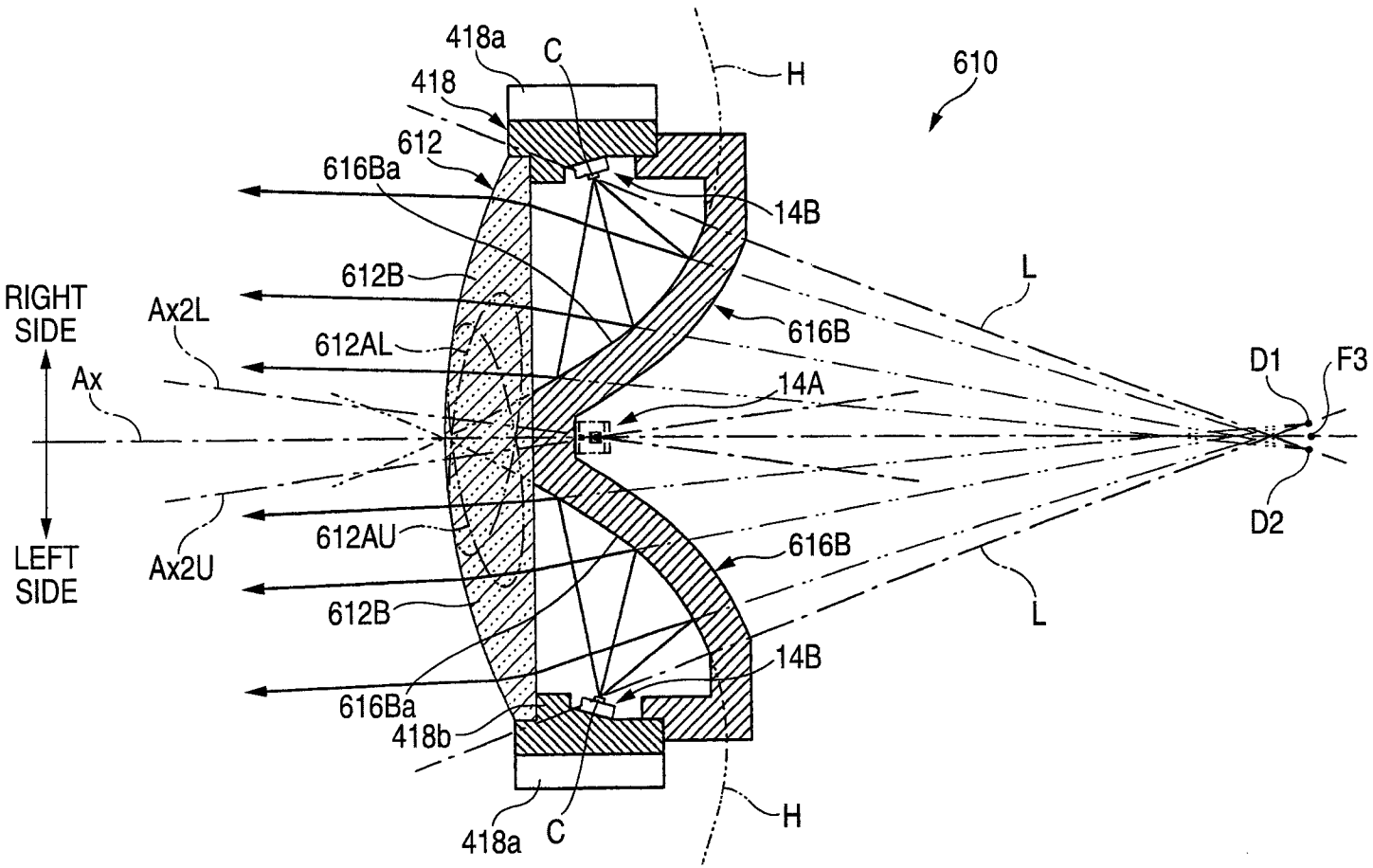
FIG. 16 is a sectional view illustrating a vehicle lamp according to a seventh exemplary embodiment of the present invention.

FIG. 16 is a similar view as FIG. 11, illustrating a vehicle lamp 610 according to a seventh exemplary embodiment of the present invention.

As shown in FIG. 16, the vehicle lamp 610 according to the seventh exemplary embodiment has a similar basic structure as that of the vehicle lamp 510 according to the sixth exemplary embodiment. However, the structures of concave lens portions 612AU, 612AL in a convex lens 612 and a structure of second reflectors 616B are different from those in the sixth exemplary embodiment.

More specifically, the concave lens portions 612AU, 612AL take similar surface shapes as those of the concave lens portions 512A according to the sixth exemplary embodiment, but have directions of optical axes Ax2U and Ax2L which are different from those of the sixth exemplary embodiment. More specifically, the concave lens portion 612AU disposed just above an optical axis Ax has optical axis Ax2U tilted toward a left side with respect to the optical axis Ax as seen on a plane. On the other hand, the concave lens portion 612AL disposed just below the optical axis Ax has optical axis Ax2L tilted toward a right side with respect to the optical axis Ax as seen on a plane. The optical axes Ax2U and Ax2L are extended in parallel with the optical axis Ax as seen from a side. Consequently, the concave lens portion 612AU serves to deflect and emit a light which is transmitted from each of the first light emitting elements 14A and is incident on the concave lens portion 612AU in a leftward direction with respect to a direction of a front of the lamp. On the other hand, the concave lens portion 612AL serves to deflect and emit a light which is transmitted from each of the second light emitting elements 14B and is incident on the concave lens portion 612AL in a rightward direction with respect to the direction of the front of the lamp.

Moreover, each second reflector 616B has a respective reflecting surface 616Ba having a shape of a hyperboloid of revolution in a similar manner as the second reflectors 416B according to the sixth exemplary embodiment. A position of a first and second focal point D1, D2 in a pair of hyperbolas, which are the base lines of the hyperboloid of revolution, is set to be slightly displaced in a horizontal direction with respect to a rear focal point F3 of a convex lens 612. More specifically, the first focal point D1 is displaced in a slightly rightward direction from the rear focal point F3 in the second reflector 616B disposed on a left side of the optical axis Ax, while the second focal point D2 is displaced in a slightly leftward direction with respect to the rear focal point F3 in the second reflector 616B disposed on a right side of the optical axis Ax.

Consequently, a light reflected by the second reflectors 616B and emitted from circumferentially-intermediate portions 612B of the convex lens 612 is deflected in the horizontal direction with respect to the forward direction of the vehicle lamp. More specifically, a light reflected by the second reflector 616B disposed on the left side of the optical axis Ax and emitted from the circumferentially-intermediate portion 612B on the left side of the optical axis Ax is deflected in a slightly leftward direction with respect to the direction of the front of the vehicle lamp, and furthermore, a light reflected by the second reflector 616B disposed on the right side of the optical axis Ax and emitted from the circumferentially-intermediate portion 612B on the right side of the optical axis Ax is deflected in a slightly rightward direction with respect to the direction of the front of the lamp.

FIGS. 17A to 17D are perspective views, each showing a light distribution pattern PF of a vehicle lamp 610 according to the seventh exemplary embodiment of the present invention. The light distribution pattern PF is formed on a virtual vertical screen disposed in a forward position of 25 m from the vehicle lamp 610 by a light irradiated forward from the lamp 610.

Figure 17A:
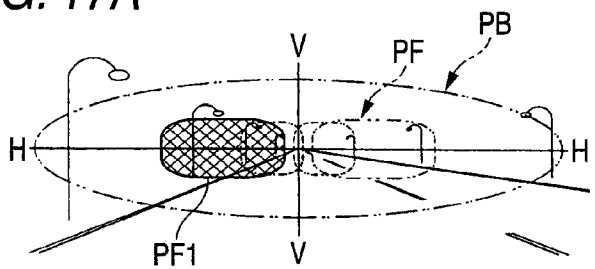
FIG. 17A to 17D are perspective views, each showing a light distribution pattern formed on a virtual vertical screen at a position of 25 m in front of the vehicle lamp by a light irradiated forward from the vehicle lamp of FIG. 16.

FIG. 17A is a view showing a light distribution pattern PF1 formed when the first light emitting element 14A positioned just above the optical axis Ax is turned ON. Since the optical axis Ax2U of the concave lens portion 612AU disposed just above the optical axis Ax is tilted toward a left side with respect to the optical axis Ax, the light distribution pattern PF1 is formed in a position which is displaced in a leftward direction with respect to the direction of the front of the vehicle lamp.

Figure 17D:
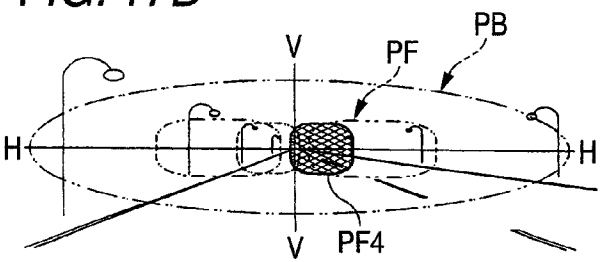
Figure 17C:
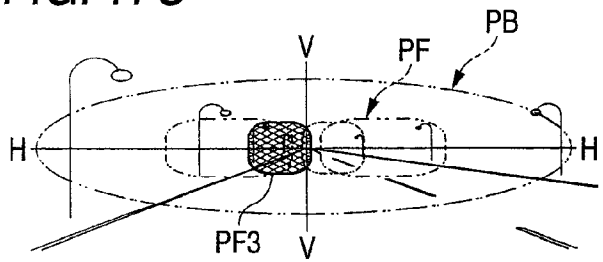
Figure 17B:
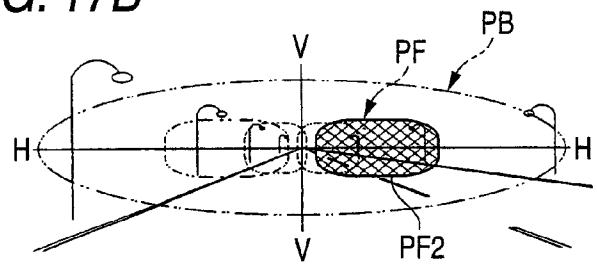

FIG. 17B is a view showing a light distribution pattern PF2 formed when the first light emitting element 14A positioned just below the optical axis Ax is turned ON. Since the optical axis Ax2L of the concave lens portion 612AL disposed just below the optical axis Ax is tilted toward a right side with respect to the optical axis Ax, the light distribution pattern PF2 is formed in a position which is displaced in a rightward direction with respect to the direction of the front of the vehicle lamp.

FIG. 17C is a view showing a light distribution pattern PF3 formed when a second light emitting element 14B positioned on the left side of the optical axis Ax is turned ON. Since a light reflected by the second reflector 616B disposed on the left side of the optical axis Ax and emitted from the circumferentially-intermediate portion 612B on the left side of the optical axis Ax is deflected in a slightly leftward direction with respect to the direction of the front of the lamp, the light distribution pattern PF3 is formed in a position which is displaced in a slightly leftward direction with respect to the direction of the front of the vehicle lamp.

FIG. 17D is a view showing a light distribution pattern PF4 formed when the second light emitting element 14B positioned on the right side of the optical axis Ax is turned ON. Since a light reflected by the second reflector 616B disposed on the right side of the optical axis Ax and emitted from the circumferentially-intermediate portion 612B on the right side of the optical axis Ax is deflected in a slightly rightward direction with respect to the direction of the front of the lamp, the light distribution pattern PF4 is formed in a position which is displaced in a slightly rightward direction with respect to the direction of the front of the vehicle lamp.

By employing a structure according to the seventh exemplary embodiment, it is possible to deflect the light emitted from each of the light emitting elements 14A, 14B in the horizontal direction from the front side of the lamp. By synthesizing four light distribution patterns PF1, PF2, PF3 and PF4 thus formed, therefore, it is possible to form the oblong synthetic light distribution pattern PF (shown in a two-dotted chain line in FIGS. 17A to 17D) in an optional expansion.

By properly turning ON each of the light emitting elements 14A, 14B to selectively form a part of the four light distribution patterns PF1, PF2, PF3 and PF4, it is also possible to sufficiently ensure a brightness in a region which is used for maintaining a forward visibility corresponding to a running situation of a vehicle. On the other hand, by decreasing the brightness for a region having a low importance, it is possible to save a consumed power and to suppress a rise in a temperature of the lamp.

While the description has been given with the assumption that the first focal point D1 of the second reflector 616B disposed on the left side is displaced to an opposite side of the second reflector 616B disposed on the left side with respect to the optical axis Ax in the seventh exemplary embodiment, it is also possible to employ a structure in which the first focal point D1 is displaced to the same side as the second reflector 616B disposed on the left side. Also in this case, the light reflected by the second reflector 616B and emitted from the circumferentially-intermediate portion 612B of the convex lens 612 can be deflected in the horizontal direction with respect to the forward direction of the vehicle lamp.

The numeric values shown as the exemplary embodiments are only illustrative and it is a matter of course that they may be properly set to have different values.

While description has been made in connection with exemplary embodiments of the present invention, those skilled in the art will understand that various changes and modification may be made therein without departing from the present invention. It is aimed, therefore, to cover in the appended claims all such changes and modifications falling within the true spirit and scope of the present invention.

What is claimed is:

1. A vehicle lamp comprising:

a lens disposed on an optical axis of the vehicle lamp, the optical axis extending in a front-and-rear direction of the vehicle lamp, the lens comprising a convex lens portion and a first concave lens portion, the first concave lens portion having a front focal point in front of the lens with respect to the front-and-rear direction of the vehicle lamp;

a plurality of light emitting elements disposed to a rear side of the lens with respect to the front-and-rear direction of the vehicle lamp and around the optical axis in a circumferential direction; and a plurality of reflectors corresponding to the plurality of light emitting elements, each of the reflectors being disposed between a corresponding one of the light emitting elements and the optical axis, wherein each of the reflectors comprises a reflecting surface which reflects light from the corresponding one of the light emitting elements toward the concave lens portion, wherein a sectional shape of the reflecting surface, taken along a plane including a light emitting center of the corresponding one of the light emitting elements and the optical axis, is an elliptical shape having a first focal point in a vicinity of the light emitting center of the corresponding one of the light emitting elements and a second focal point in front of the concave lens portion, and wherein the plurality of reflectors are arranged to share the same second focal point;

the first concave lens portion being formed as a recess in a front surface of the convex lens portion.

2. The vehicle lamp according to claim 1, wherein the second focal point is located in a vicinity of the front focal point of the concave lens portion.

3. The vehicle lamp according to claim 1, wherein the concave lens portion comprises a Fresnel lens portion.

4. The vehicle lamp according to claim 1, wherein a focal ratio of the concave lens portion is less than or equal to one.

5. The vehicle lamp according to claim 1, further comprising a metallic member on which the plurality of light emitting elements are supported, wherein the metallic member comprises a plurality of radiation fins on an outer peripheral side of the plurality of light emitting elements with respect to the optical axis.

6. The vehicle lamp according to claim 1, further comprising a lens holder comprising a front end surrounding the lens to hold the lens, a rear end to which the plurality of reflectors are fixed, and a portion on which the light emitting elements are arranged along the circumferential direction.

7. The vehicle lamp according to claim 1, wherein the first concave lens portion has an aspherical shape.

8. The vehicle lamp according to claim 1, wherein the reflecting surface of each of the reflectors extends toward the optical axis such that a front end of the reflecting surface is disposed adjacent to a flat rear surface of the lens at a central location near the optical axis.

9. A vehicle lamp comprising:

a lens disposed on an optical axis of the vehicle lamp, the optical axis extending in a front-and-rear direction of the vehicle lamp, the lens comprising a first concave lens portion;

a plurality of light emitting elements disposed to a rear side of the lens and around the optical axis in a circumferential direction, the plurality of light emitting elements comprising at least one first light emitting element disposed to a rear side of the first concave lens portion;

at least one first reflector corresponding to the at least one first light emitting element and disposed between the corresponding first light emitting element and the optical axis, wherein the first reflector comprises a first reflecting surface which reflects light from the corresponding first light emitting element toward the first concave lens portion, wherein the vehicle lamp further comprises at least one auxiliary reflector corresponding to the at least one first light emitting element and disposed in proximity to the at least one first light emitting element, wherein the auxiliary reflector reflects light from the first light emitting element toward an associated one of the at least one first reflectors such that the light is converged at a converging point between the first light emitting element and the optical axis, wherein the associated one of the first reflectors is disposed between the converging point and the optical axis, and wherein a sectional shape of the first reflecting surface is an elliptical shape having a first focal point in a vicinity of the converging point and a second focal point in a vicinity of the front focal point of the first concave lens portion.

10. A vehicle lamp comprising:

a lens disposed on an optical axis of the vehicle lamp, the optical axis extending in a front-and-rear direction of the vehicle lamp, the lens comprising a convex lens portion and a first concave lens portion, the first concave lens portion having a front focal point in front of the lens with respect to the front-and-rear direction of the vehicle lamp;

a plurality of light emitting elements disposed to a rear side of the lens with respect to the front-and-rear direction of the vehicle lamp and around the optical axis in a circumferential direction, the plurality of light emitting elements comprising at least one first light emitting element disposed to a rear side of the first concave lens portion with respect to the front-and-rear direction of the vehicle lamp; and at least one first reflector corresponding to the at least one first light emitting element and disposed between the corresponding first light emitting element and the optical axis, wherein the first reflector comprises a first reflecting surface which reflects light from the corresponding first light emitting element toward the first concave lens portion, wherein a sectional shape of the first reflecting surface, taken along a plane including a light emitting center of the corresponding first light emitting element and the optical axis, is an elliptical shape, and the first reflecting surface having a first focal point in a vicinity of the light emitting center of the corresponding first light emitting element and a second focal point in front of the first concave lens portion;

at least one second reflector, wherein the plurality of light emitting elements further comprise at least one second light emitting element disposed to a rear side of the convex lens portion with respect to the front-and-rear direction of the vehicle lamp, the at least one second reflector corresponding to the at least one second light emitting element, wherein the second reflector is disposed between the corresponding second light emitting element and the optical axis, wherein the second reflector comprises a second reflecting surface which reflects light from the corresponding second light emitting element toward the convex lens portion, and a sectional shape of the second reflecting surface, taken along a plane including a light emitting center of the corresponding second light emitting element and the optical axis, is a shape of one branch of a hyperbola on a side of the corresponding second light emitting element, the hyperbola having a first focal point in a vicinity of a rear focal point of the convex lens portion and a second focal point in a vicinity of the light emitting center of the corresponding second light emitting element;

the first concave lens portion being formed as a recess in a front surface of the convex lens portion.

11. The vehicle lamp according to claim 10, further comprising a third reflector, wherein the lens further comprises a second concave lens portion formed as a recess in the front surface of the convex lens portion, the second concave lens portion having a front focal point in front of the lens with respect to the front-and-rear direction of the vehicle lamp, and the plurality of light emitting elements further comprises a third light emitting element disposed to a rear side of the second concave lens portion with respect to the front-and-rear direction of the vehicle lamp, wherein a part of the convex lens portion is disposed between the first concave lens portion and the second concave lens portion, wherein the third reflector is disposed between the third light emitting element and the optical axis, and wherein the third reflector comprises a third reflecting surface which reflects light from the third light emitting element toward the second concave lens portion, and a sectional shape of the third reflecting surface, taken along a plane including a light emitting center of the third light emitting element and the optical axis, is an elliptical shape having a first focal point in a vicinity of the light emitting center of the third emitting element and a second focal point in a vicinity of a front focal point of the second concave lens portion.

12. The vehicle lamp according to claim 11, wherein the first concave lens portion is disposed on an upper side of the optical axis, and the second concave lens portion is disposed on a lower side of the optical axis.

13. The vehicle lamp according to claim 12, wherein a focal length in a horizontal plane is different from a focal length in a vertical plane for each of the first concave lens portion and the second concave lens portion.

14. The vehicle lamp according to claim 12, wherein an optical axis of each of the first concave lens portion and the second concave lens portion is tilted in a tilting direction in a horizontal direction with respect to the optical axis of the vehicle lamp.

15. The vehicle lamp according to claim 12, wherein the first focal point of the hyperbola is displaced in a horizontal direction with respect to the rear focal point of the convex lens portion.

16. The vehicle lamp according to claim 11, wherein each of the first concave lens portion and the second concave lens portion has an aspherical shape, and the convex lens portion has an aspherical shape.

17. The vehicle lamp according to claim 11, wherein the first reflecting surface, the second reflecting surface and the third reflecting surface extend toward the optical axis such that a front end of each of the first reflecting surface, the second reflecting surface, and the third reflecting surface is disposed adjacent to a flat rear surface of the lens at a central location near the optical axis.

18. The vehicle lamp according to claim 10, wherein the first concave lens portion has an aspherical shape, and the convex lens portion has an aspherical shape.

19. The vehicle lamp according to claim 10, wherein the first reflecting surface and the second reflecting surface extend toward the optical axis such that a front end of each of the first reflecting surface and the second reflecting surface is disposed adjacent to a flat rear surface of the lens at a central location near the optical axis.

* * * * *